US011134714B2

(12) United States Patent
Prog et al.

(10) Patent No.: US 11,134,714 B2
(45) Date of Patent: Oct. 5, 2021

(54) SMOKING FILTRATION DEVICES, METHODS, AND SYSTEMS

(71) Applicant: SMASK, LLC, Brooklyn, NY (US)

(72) Inventors: Leonid Prog, Brooklyn, NY (US); Dillon Galynsky, Brooklyn, NY (US)

( * ) Notice: Subject to any disclaimer, the term of this patent is extended or adjusted under 35 U.S.C. 154(b) by 313 days.

(21) Appl. No.: 16/191,629

(22) Filed: Nov. 15, 2018

(65) Prior Publication Data

US 2020/0154760 A1 May 21, 2020

(51) Int. Cl.

| | |
|---|---|
| ***A24D 3/06*** | (2006.01) |
| ***A24D 3/04*** | (2006.01) |
| ***A24D 3/18*** | (2006.01) |

(52) U.S. Cl.

CPC ..... *A24D 3/062* (2013.01); *A24D 3/043* (2013.01); *A24D 3/067* (2013.01); *A24D 3/18* (2013.01)

(58) Field of Classification Search

CPC ..... A24D 3/18; A24D 3/043; A24D 3/062; A24D 3/06; A24D 3/00; A24D 3/04–048; A24F 13/00; A24F 13/02; A24F 13/04; A24F 13/06; A24F 13/14; A24F 13/22

USPC ..... 131/331, 338, 339, 340, 341, 342, 344, 131/209–213, 215.1–218, 174, 175, 185, 131/187, 189, 240.1–242.5

See application file for complete search history.

(56) References Cited

U.S. PATENT DOCUMENTS

| | | | | | |
|---|---|---|---|---|---|
| 3,695,275 | A | * | 10/1972 | Hayward | A24F 13/04 131/271 |
| 4,790,332 | A | * | 12/1988 | Wallace | A24F 13/00 131/175 |
| 4,807,646 | A | * | 2/1989 | Sahar | A24F 13/00 131/175 |
| 4,899,766 | A | * | 2/1990 | Ross, Jr. | A24F 13/00 131/175 |
| 5,160,518 | A | * | 11/1992 | Vega, Jr. | B01D 46/00 55/385.8 |
| 5,353,814 | A | * | 10/1994 | Martin | A24F 13/00 131/175 |
| 5,388,595 | A | * | 2/1995 | Shafer | A24F 13/00 131/175 |
| 5,396,907 | A | * | 3/1995 | Rojas Henao | A24F 13/00 131/175 |
| 5,469,870 | A | * | 11/1995 | Meador | A24F 13/00 131/187 |
| 5,495,859 | A | * | 3/1996 | Bowen | A24F 13/00 131/202 |
| 5,501,234 | A | * | 3/1996 | Hyre | A24F 13/00 131/187 |
| 5,529,078 | A | * | 6/1996 | Rehder | A24F 13/00 131/175 |
| 5,598,853 | A | * | 2/1997 | Hyre | A24F 13/00 131/175 |
| 6,006,757 | A | * | 12/1999 | Lichtenberg | A24F 13/00 131/187 |
| 6,012,459 | A | * | 1/2000 | Keefe | A24F 13/00 131/185 |
| 6,158,530 | A | * | 12/2000 | Bowen | A24F 13/00 131/175 |

(Continued)

*Primary Examiner* — Michael H. Wilson
*Assistant Examiner* — Yana B Krinker

(57) ABSTRACT

The subject disclosure relates to a device for smoking and filtering smoke. In an aspect, the device can comprise an outer sleeve component, a detachable mouthpiece assembly, an ignition chamber assembly, and a detachable filtration assembly.

18 Claims, 17 Drawing Sheets

(56) References Cited

U.S. PATENT DOCUMENTS

| | | | | |
|---|---|---|---|---|
| 6,431,176 | B1 * | 8/2002 | Rice | A24F 13/00 131/175 |
| 7,861,726 | B1 * | 1/2011 | Lukasavitz | A24F 13/00 131/175 |
| 10,306,920 | B1 * | 6/2019 | Valdes | F23Q 7/22 |
| 10,405,576 | B1 * | 9/2019 | Adams | A24F 13/00 |
| 2007/0074734 | A1 * | 4/2007 | Braunshteyn | A24F 13/00 131/328 |
| 2007/0204868 | A1 * | 9/2007 | Bollinger | A24F 13/00 131/174 |
| 2007/0283971 | A1 * | 12/2007 | Gidding | A24F 13/00 131/202 |
| 2008/0060664 | A1 * | 3/2008 | Richards | A24F 13/00 131/202 |
| 2008/0230077 | A1 * | 9/2008 | Martilik | A24F 13/00 131/202 |
| 2009/0007926 | A1 * | 1/2009 | Gidding | A24F 13/00 131/331 |
| 2009/0056728 | A1 * | 3/2009 | Baker | A24F 13/00 131/191 |
| 2011/0073120 | A1 * | 3/2011 | Adamic | A24F 13/06 131/328 |
| 2011/0240047 | A1 * | 10/2011 | Adamic | A24F 3/00 131/328 |
| 2013/0180535 | A1 * | 7/2013 | Rooijakkers | A24D 3/18 131/331 |
| 2013/0233328 | A1 * | 9/2013 | Jang | A24F 13/00 131/187 |
| 2018/0042299 | A1 * | 2/2018 | Han | A24F 40/30 |
| 2019/0037923 | A1 * | 2/2019 | Shenkal | A24F 7/00 |
| 2020/0154760 | A1 * | 5/2020 | Prog | A24F 13/00 |

* cited by examiner

SMOKING FILTRATION DEVICES, METHODS, AND SYSTEMS

TECHNICAL FIELD

This disclosure relates to devices, systems, and methods for filtering smoke.

BACKGROUND

There has long been an unmet need for a means to filter smoke for health reasons and for odor reasons, but the state of the art is lacking in many ways. Traditionally, smokers use filtered cigarettes or e-cigarettes to perform filtered smoking, however, such cigarette technologies still permit an undesirable odor and smoke contaminants as well as particles to permeate through the surrounding environment of the smoker. Furthermore, smokers tend to receive less enjoyment from smoking out of devices like e-cigarettes due to the altered sensation experienced from inhaling an evaporated e-liquid material via an e-cigarette as compared to the sensation experienced from a natural burn of tobacco within a traditional cigarette. Also, the smoking experience with e-cigarettes is less preferred for some users than conventional cigarette smoking in that e-cigarettes utilize warming mechanisms (e.g., heating a coil) for smoking whereas a traditional cigarette is smoked using a combustion-based approach (e.g., using a lighter to light the cigarette cylinder). Furthermore, in current smoking formats and devices, users experience several nuisances while smoking such as having ash hit their body (e.g., in their eyes) or being inhaled as well as being exposed to extreme heat generated from a pre-existing industrial or personal cigarette combustion process. As such, there is a need for technologies that solve the above-mentioned problems with smoking.

SUMMARY

The following presents a summary to provide a basic understanding of one or more embodiments of the invention. This summary is not intended to identify key or critical elements or delineate any scope of the particular embodiments or any scope of the claims. Its sole purpose is to present concepts in a simplified form as a prelude to the more detailed description that is presented later. In one or more embodiments described herein are systems, devices, apparatuses, and methods that employ components to facilitate filtered smoking.

According to an embodiment, a device is provided that comprises an outer casing component comprising a first cavity portion and a second cavity portion; a detachable mouthpiece assembly configured for insertion into or removal from the first cavity portion; a holder component configured to hold a smoking media item based on a gripping mechanism; a mouthpiece air pathway component configured to transfer a first stream of smoke in a first direction corresponding to an inhale pathway or a second stream of smoke in a second direction corresponding to an exhale pathway, wherein the first direction is opposite to the second direction; a first valve component configured to direct a first flow of smoke from the smoking media item to the inhale pathway via a contoured smoke propagation cavity and a central inhale route; and an exhale ballcheck valve assembly configured to direct a second flow of smoke through the exhale pathway.

In another aspect, the device comprises an ignition chamber assembly configured to generate the stream of smoke for movement in the first direction and transition the second stream of smoke between a set of device components; wherein the ignition chamber assembly is configured to attach to the detachable mouthpiece assembly, and wherein the spring helix assembly comprises: a spring-helix component within a spring-helix holding chamber portion, wherein the spring-helix component is configured to house the smoking media item and based on an exhale event, facilitate a transference of the second flow of smoke from the spring helical cavity into a filtration assembly via a smoke exhaust component that is a connection pathway between the inner spring helical cavity and a cyclonic filter component of the filter assembly; and an ignition component within the ignition chamber assembly configured to generate a flame based on an electrical or photonic (laser) ignition mechanism; wherein the flame is capable of igniting the smoking media item.

In yet another aspect, the device comprises a detachable filtration assembly configured for a novel insertion mechanism into or removal from the second cavity portion, wherein the detachable filtration assembly removes a set of particles from the second flow of smoke, wherein the detachable filtration assembly is connected to the spring helix assembly via a central structural column, and wherein the detachable filtration assembly comprises: a curved smoke diffuser configured to distribute air pressure in a manner that spreads the second flow of smoke through a set of filtration membranes into a HEPA media weave component; a HEPA media weave component configured to mitigate a loss of air pressure of the second flow of smoke based on a folding style of a set of HEPA media folds corresponding to the HEPA media weave component, wherein the HEPA media weave component comprises a HEPA fabric with glass fiber membranes; an activated carbon component configured to adsorb a HEPA media filtrated second flow of smoke; and an exit nozzle component located at a top portion of the partially detachable filtration assembly and configured to remove a filtered second stream of smoke, it is positioned in such a way to not direct filtrated smoke and carbon residue back into the face of the user.

DETAILED DESCRIPTION

The following detailed description is merely illustrative and is not intended to limit embodiments and/or application or uses of embodiments. Furthermore, there is no intention to be bound by any expressed or implied information presented in the preceding Background or Summary sections, or in the Detailed Description section. One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evident, however, in various cases, that the one or more embodiments can be practiced without these specific details.

Aspects and advantages of the invention will be set forth in part in the following description, or may be obvious from the description, or may be learned through practice of the invention. Implementations may include one or a combination of any two or more of the aforementioned features. These and other aspects, features, implementations, and advantages, and combinations of them, can be expressed as methods, apparatus, systems, devices, components, computer program products, computer-implemented methods, computer-implemented systems, business methods, and means or steps for performing functions, or combinations of them. Other features, aspects, implementations, and advantages will become apparent from the description, the drawings, and the claims.

Figure 1A:
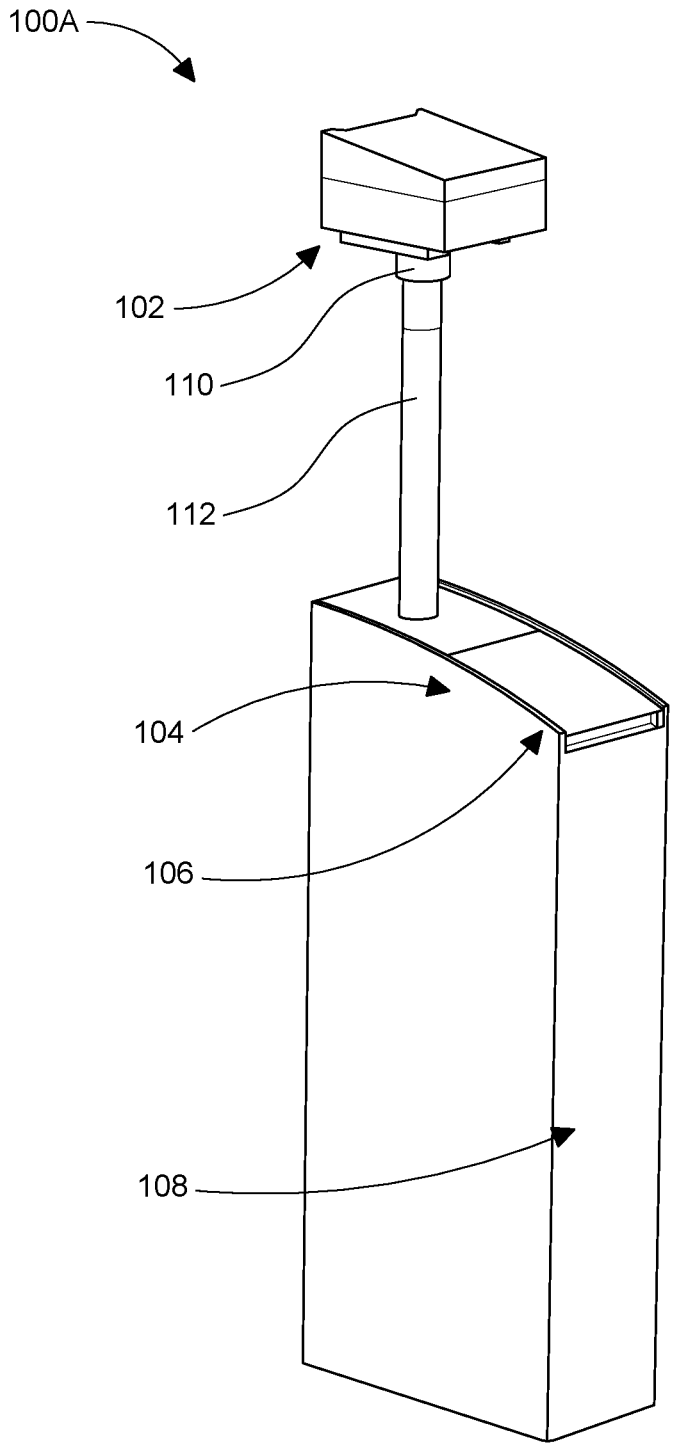
FIG. 1A illustrates a diagram of an example, external perspective view of a non-limiting smoking filtration device 100A including, but not limited to the detachable mouthpiece assembly and device outer casing, that can facilitate a filtered smoking of smoking media item in accordance with one or more embodiments described herein.

FIG. 1A illustrates a diagram of an example, external perspective view of a non-limiting smoking filtration device 100A including, but not limited to the detachable mouthpiece assembly and device outer casing, that can facilitate a filtered smoking of smoking media item in accordance with one or more embodiments described herein.

In an aspect, device 100A can comprise detachable mouthpiece assembly 102, detachable filtration assembly 104, exit nozzle component 106, outer sleeve component 108, and holder component 110. In another aspect, a smoking media item 112 can be inserted into the device 100A for smoking. In yet another aspect, device 100A can comprise several internal components (not shown in FIG. 1A), including but not limited to, components of detachable mouthpiece assembly 102 such as exhale ballcheck duct 260, first valve component 270, mouthpiece air pathway component 280, vented stress point 290, holder component 110. Furthermore, device 100A can comprise components of spring-helix holding chamber 273 including spring-helix fastening plate component 204, spring-helix holder slip portion 202, spring-helix component 210, and arc lighter housing component 214.

In another aspect, device 100A can comprise components of ignition chamber assembly 275 including, but not limited to, arc lighter housing component 214, lighter-shuttle fastening plate 208, lighter-shuttle assembly 220, igniter air-inlet tunnel 212, pressure differential surface 216, lighter shuttle chassis component 206, valve insert portion 258, umbrella valve 240, smoke exhaust component 230, accordion electrical route component 218, external air-inlet orifice 222, electrical interface component 264, lower portion shuttle rail assembly 262, electrical housing component 224, electrical housing fastening plate 226. Also included (not shown in FIG. 1) internally is a central structural column 256, a cyclonic filter assembly 277 including, but not limited to, ash sediment collection portion 228, detachable ashtray endcap component 232, cyclonic filter component 234, electrical precipitator component 236, pre-filter umbrella valve component 266, and filter pod base 220. In another aspect, device 100A can include a detachable filtration assembly 104 including, but not limited to, curved smoke diffuser 254, central weave peg 252, set of structural weave pegs 248, HEPA media weave component 246, activated carbon component 244, extended HEPA media component 242, removable filterpod endcap component 238, upper filter clip hook 239, and lower filter clip hook 241.

In general, device 100A can be a secondhand and side stream smoke purifying device. A user (e.g., consumer of smoking products, smoker, etc.) can commence its interaction by powering on the device 100A (e.g., clicking a button, using a capacitive touch screen, engaging a switch or lever or other actuator). Upon a powering on of device 100A, the device 100A can present a set of data at a user interface such as filter lifespan data, battery life, and other user related metrics. Illustrated in FIG. 1A is an external view of device 100A and its external components. In an aspect, device 100A can comprise an outer sleeve component 108 comprising a first cavity portion and a second cavity portion. In an aspect, the first cavity portion includes an orifice of which detachable mouthpiece assembly 102 can be inserted and removed. In another aspect, the second cavity portion can include a containment space for a fitting, insertion or removal of detachable filtration assembly 104. In another aspect, outer sleeve component 108 can be configured to provide a sleeve for the internal and/or detachable assemblies of device 100A to slide into or out of easily. In a non-limiting embodiment, the internal device assemblies can be injection molded within the corpus of device 100A. In some non-limiting embodiments, internal device assemblies can be injection molded to allow for an optimization of fluid dynamics with respect to the implementation and specifications of some ignition systems (e.g., those employing laser ignition mechanisms). In another aspect, the internal contour structure of spring helix component 210 allows for the second flow of smoke to corkscrew along the internal cavity of the helix and increase in velocity from the corkscrewing movement prior to entering cyclonic filter assembly 277. In another aspect, outer sleeve component 108 can provide a sealed fit of device assemblies ensuring no smoke leaks around the internal assemblies.

In an aspect, device 100A can include detachable mouthpiece assembly 102 representing a set of components and configured for insertion into or removal from the first cavity portion of device 100A. The detachment capability of the entire assembly allows for the insertion of a smoking media item 112 (e.g., cigarette, cannabis cigarette, etc.) within holder component 110. In an aspect, smoking media item 112 can be any factory or hand-rolled herb having a varied set of dimensions (e.g., 100 mm in length with carriable diameters in a non-limiting embodiment). Furthermore, a detachment of detachable mouthpiece assembly 102 also allows for the removal of a used smoking media item 112 (e.g., cigarette butt).

In an aspect, detachable mouthpiece assembly 102 can comprise two inverse unidirectional valves which allow for a bi-directional smoke flow within device 100A. For instance, a user can inhale smoke emanating from a smoking media item 112 and subsequently exhale into the device sending the exhaled smoke through a series of filtration components and exiting the device 100A as filtered smoke through exit nozzle component 106. In an aspect, detachable mouthpiece assembly 102 can allow for inhaled smoke and exhaled smoke to pass through its internal components. In another aspect, detachable mouthpiece assembly 102 has an ergonomic fit with a user's mouth. In yet another aspect, holder component 110 of detachable mouthpiece assembly 102 inserts into a port or orifice of device 100A to create an air-tight seal based on the contours of the port or orifice and the fit of the holder component 110. In a non-limiting example embodiment, holder component can comprise a terraced rib component to grip into inhale-filters of smoking media items 112 (e.g., cigarettes) having variable diameters.

In another aspect, a holder component 110 can be configured to hold a smoking media item 112 based on a gripping mechanism. For instance, in an aspect, holder component 110 can be a ribbed conical holder of a smoking media item 112 (e.g., cigarette) that is capable of securing a range of smoking media items 112 of varying dimensions and sizes (e.g., different diameters and lengths). In another aspect, holder component 110 can be inset within detachable mouthpiece assembly 102 and have ribs made of a material composition (e.g., silicone, elastic polymers or other adhering materials) capable of acting as a sealant or coating around a filter of smoking media item 112. As disclosed above, exit nozzle component 106 can be configured as an exit port to smoke flows after a stream of smoke has passed through all filtration stages of device 100A. In another aspect, exit nozzle component 106 can be located at a top portion of detachable filtration assembly 104 and remove a filtered second stream of smoke from device 100A and into an external environment. In another aspect, exit nozzle component 106 can be capped off with filterpod end cap 238 of device 100A (not illustrated in FIG. 1A).

In yet another aspect, FIG. 1A illustrates detachable filtration assembly 104 of device 100A, which can be configured for insertion into or removal from the second cavity portion, wherein the detachable filtration assembly removes a set of particles from the second flow of smoke, wherein the detachable filtration assembly is connected to the spring helix assembly via a central structural column 256 (not illustrated in FIG. 1A). In an aspect, detachable filtration assembly 104 can be configured for insertion and/or removal from the second cavity portion of device 100A via a range of mechanical methods (e.g., pop-in, clip-in, fastening, etc.) for insertion of carbon-HEPA filtration components. In an aspect, detachable filtration assembly 104 can be configured to filter out smoke stream after ash is removed from such smoke via cyclonic filter component 234 (not illustrated in FIG. 1A). In yet another aspect, an airflow within the filter pod can be optimized to ensure a minimum pressure reduction occurs across HEPA membranes and activated carbon as smoke stream exits device 100A via exit nozzle component 106.

In another aspect, HEPA media weave component 246 and activated carbon mixtures of detachable filtration assembly 104 can filter from the smoke stream a range of particles (e.g., volatile organic compounds or odor particles) of varying sizes. In a non-limiting embodiment, detachable filtration assembly 104 can include a filter pod with an encrypted chip or microprocessor that can facilitate safety and inhibit tampering of device 100A. As an example, a chip (e.g., printed circuit board), as well as contact-pin male-port components of the chip in the corpus of a filter pod can be employed. Furthermore, pins can click into a female port with the inside of device 100A as a filter pod is properly seated in the device 100A. In another aspect, the chip can be encrypted with a proprietary key capable of verification using Bluetooth connectivity to allow for network connectivity with various networks (e.g., cloud computing networks).

As a non-limiting example implementation of device 100A, detachable mouthpiece 102 can be pulled out (e.g., pop-out, spring loaded, screw-in, or mounted by another mechanism that creates a seal) from first cavity portion (e.g., a mouthpiece-port) which unveils an inner-cavity of holder component 110. In another aspect, a smoking media item 112 such as a cigarette or other filtered smoking media can be inserted into a ribbed version of holding component 110 to create an air-tight seal around a circumference of the cigarette filter. As such, detachable filtration assembly 104 with the smoking media item 112 being held by holder component 110 can be inserted into the first cavity portion of device 100A creating an air-tight seal and enclosing the filtered cigarette within a pressure-controlled and air-sealed internal housing.

Upon smoking media item 112 insertion into device 100A first cavity portion, a processing system employed by device 100A, can perform a check protocol to make sure smoking media item 112 is properly aligned and seated to increase the likelihood of a flawless ignition of smoking media item 112. At this point, with the smoking media item 112 inserted into device 100A and device 100A in the on-state, the user can begin the active smoking experience. The user begins by inhaling from the device 100A opening, which triggers the lighter to ignite the smoking media item 112, the inhale valve to open, allowing smoke to enter the lungs and the lighter-air-inlet valve to open, feeding in oxygen into the point of ignition. This process delivers a puff which is completely authentic to the real-feel of smoking. After each puff, the inlet-valve closes, allowing the ambient smoke and subsequent lack of oxygen to smother or extinguish the flame to be relit during the next inhale.

In an aspect, after the smoke passes through detachable filtration assembly 104, the smoke can pass through a deodorizing membrane (e.g., scented membrane) and exit device 100A into the open air via exit nozzle component 106. The exiting smoke can comprise a drastic reduction of volatile organic compounds (VOC) as compared to the original exhaled smoke that entered device 100A. Furthermore, in an aspect, the exiting smoke can be void of visible fumes and/or smoke odor.

Figure 1B:
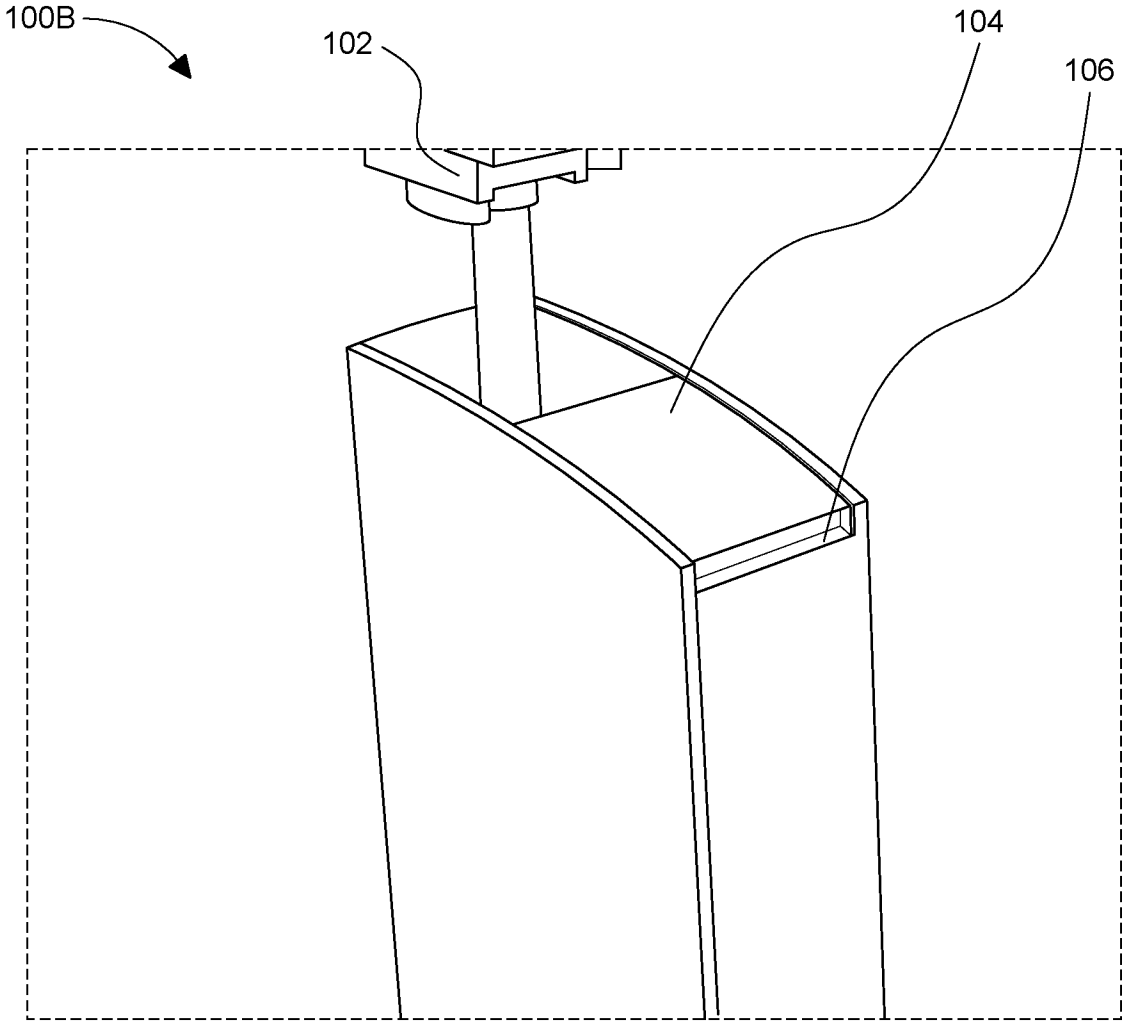
FIG. 1B illustrates a diagram of an example, closeup external perspective view of a non-limiting smoking filtration device 100B including, but not limited to the detachable mouthpiece assembly which is illustrated as partially detached, detachable filtration assembly, and device outer casing, that can facilitate a filtered smoking of smoking media item in accordance with one or more embodiments described herein.

Turning now to FIG. 1B, illustrated is a diagram of an example, closeup external perspective view of a non-limiting smoking filtration device 100B including, but not limited to the detachable mouthpiece assembly which is illustrated as partially detached, detachable filtration assembly, and device outer casing, that can facilitate a filtered smoking of smoking media item in accordance with one or more embodiments described herein. In an aspect, device 100B can comprise all of the elements of device 100A, however the illustration includes a closeup view of the top portion of device 100B. In an aspect, device 100B can comprise detachable mouthpiece assembly 102, detachable filtration assembly 104, exit nozzle component 106. Repetitive description of like elements employed in other embodiments described herein is omitted for sake of brevity.

Figure 1C:
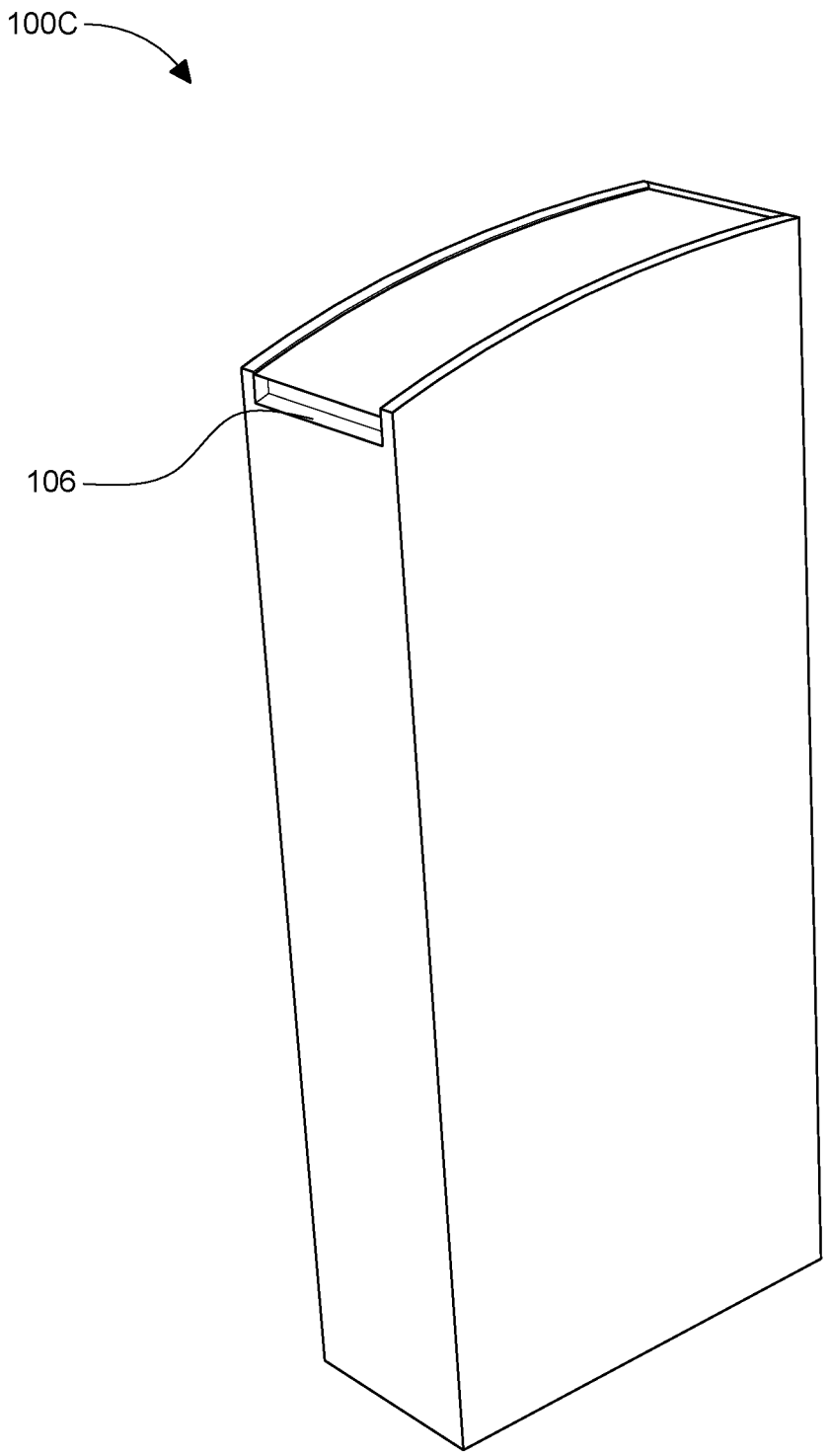
FIG. 1C illustrates a diagram of an example, external perspective view of a non-limiting smoking filtration device 100C including, but not limited to, the detachable mouthpiece assembly which is fully inserted and device outer casing, that can facilitate a filtered smoking of smoking media item in accordance with one or more embodiments described herein.

FIG. 1C illustrates a diagram of an example, external perspective view of a non-limiting smoking filtration device 100C including, but not limited to, the detachable mouthpiece assembly which is fully inserted and device outer casing, that can facilitate a filtered smoking of smoking media item in accordance with one or more embodiments described herein. In an aspect, device 100C can comprise all of the elements of devices 100A and device 100B (e.g., different perspective views of device 100C), however the illustration in FIG. 1C includes a different perspective view of an angled side view portion of device 100C. In an aspect, device 100C can comprise detachable mouthpiece assembly 102 (not referenced in the illustration), detachable filtration assembly 104 (not referenced in the illustration) and exit nozzle component 106. In an aspect, device 100C includes all detachable assemblies fully inserted within the first cavity portion and the second cavity portion, thus having a smooth continuous design at the top of device 100C. Furthermore, the insertion of respective assemblies into first cavity portion and second cavity portion creates an airtight seal such that smoke can optimally pass bi-directionally throughout the device 100C. Repetitive description of like elements employed in other embodiments described herein is omitted for sake of brevity.

Figure 1D:
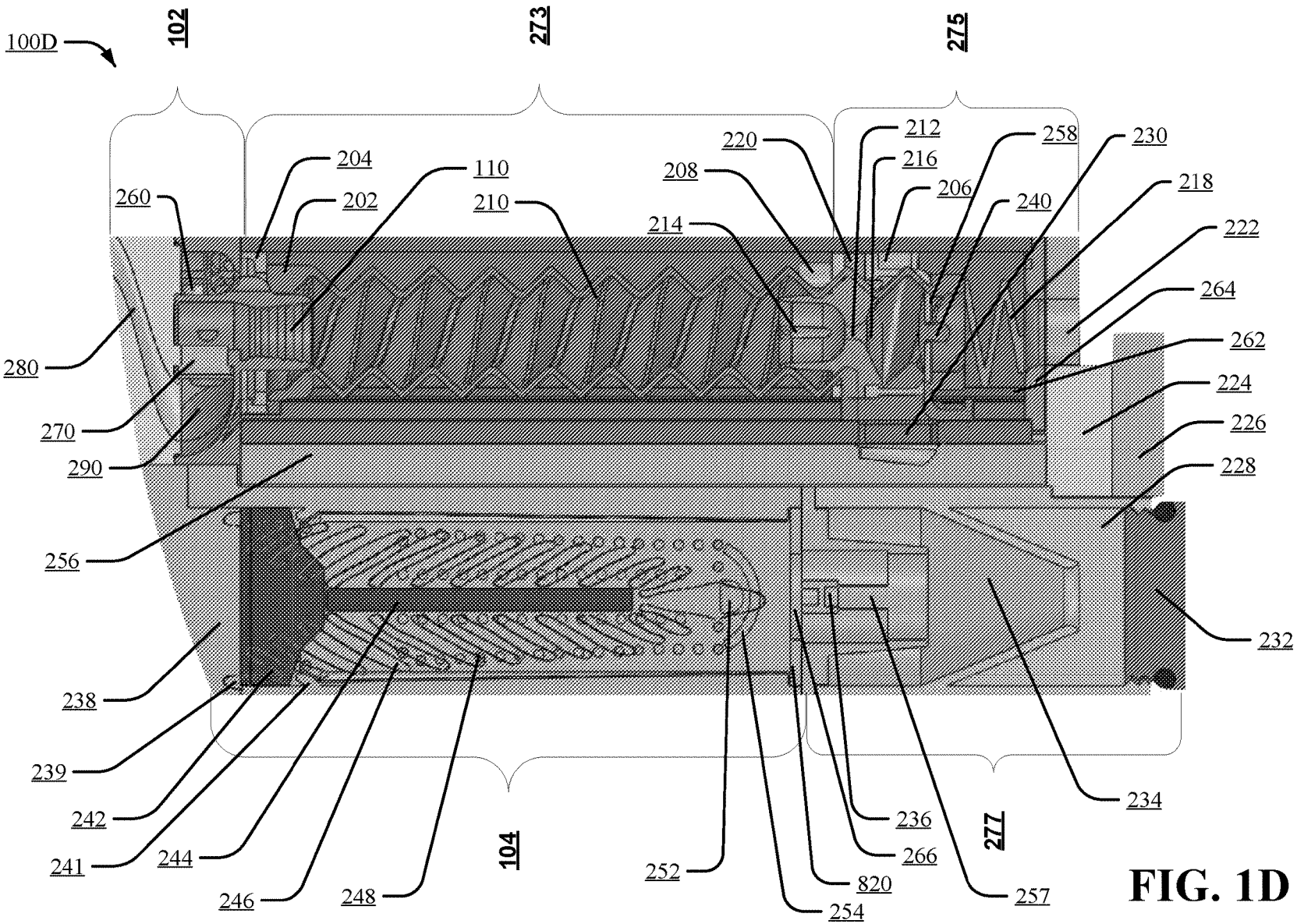
FIG. 1D illustrates a diagram of an example, cross-sectional, internal perspective view of a non-limiting smoking filtration device 100D, including but not limited to, a detachable mouthpiece assembly, a spring-helix holding chamber, an ignition chamber assembly, detachable filtration assembly, and cyclonic filter assembly that can facilitate a filtered smoking of a smoking media item in accordance with one or more embodiments described herein.

Turning now to FIG. 1D, illustrated is a diagram of an example, cross-sectional, internal perspective view of a non-limiting smoking filtration device 100D, including but not limited to, a detachable mouthpiece assembly 102, a spring-helix holding chamber 273, an ignition chamber assembly 275, detachable filtration assembly 104, and cyclonic filter assembly 277 that can facilitate a filtered smoking of a smoking media item in accordance with one or more embodiments described herein. In an aspect, device 100D can comprise all of the elements of devices 100A-C, however the illustration includes a view of the internal components of device 100D rather than the exterior view of outer components and assemblies illustrated in FIG. 1A-1C. Repetitive description of like elements employed in other embodiments described herein is omitted for sake of brevity.

In an aspect, device 100D can comprise detachable mouthpiece assembly 102, detachable filtration assembly 104, exit nozzle component 106 (not illustrated in FIG. 1D), outer sleeve component 108 (not illustrated in FIG. 1D), holder component 110, spring-helix holding chamber 273, ignition chamber assembly 275, and cyclonic filter assembly 277. In another aspect, a smoking media item 112 (not illustrated in FIG. 1D) can be inserted into holder component 110 for smoking. In yet another aspect, device 100D can comprise several internal components, including but not limited to, components of detachable mouthpiece assembly 102 such as exhale ballcheck duct 260, first valve component 270, mouthpiece air pathway component 280, vented stress point 290, holder component 110. Furthermore, device 100D can comprise components of spring-helix holding chamber 273 including spring-helix fastening plate component 204, spring-helix holder slip portion 202, spring-helix component 210, and arc lighter housing component 214.

In another aspect, device 100D can comprise components of ignition chamber assembly 275 including, but not limited to, arc lighter housing component 214, lighter-shuttle fastening plate 208, lighter-shuttle assembly 220, igniter air-inlet tunnel 212, pressure differential surface 216, lighter shuttle chassis component 206, valve insert portion 258, umbrella valve 240, smoke exhaust component 230, accordion electrical route component 218, external air-inlet orifice 222, electrical interface component 264, lower portion shuttle rail assembly 262, electrical housing component 224, electrical housing fastening plate 226. Also included internally is a central structural column 256 and a cyclonic filter assembly 277 including, but not limited to, ash sediment collection portion 228, detachable ashtray endcap component 232, cyclonic filter component 234, electrical precipitator component 236, pre-filter umbrella valve component 266, and filter pod base 220. In another aspect, device 100A can include a detachable filtration assembly 104 including, but not limited to, curved smoke diffuser 254, central weave peg 252, set of structural weave pegs 248, HEPA media weave component 246, activated carbon component 244, extended HEPA media component 242, removable filterpod endcap component 238, upper filter clip hook 239, and lower filter clip hook 241.

In FIG. 1D, device 100D can comprise segments that indicate a region or assembly of device 100D components such as ignition chamber assembly 275, spring-helix holding chamber 273, cyclonic filter assembly 277, detachable filtration assembly 104, and detachable mouthpiece assembly 102. In an aspect, detachable mouthpiece assembly 102 can include an exhale ballcheck duct 260 which is a portion of an exhale pathway comprising a smoke intake portion, the exhale ballcheck duct 260, and a ballcheck exhale duct opening 660 (illustrated in FIG. 1H), wherein the exhale ballcheck duct 260 is a pathway for the second flow of smoke to travel within based upon a dislodging of a sphere component 610 (illustrated in FIG. 1H) within the ballcheck exhale duct opening 660 of the exhale pathway. In an aspect, exhale ballcheck duct 260 can serve as a pathway for exhaled smoke to travel once sphere component 610 is dislodged from ballcheck exhale duct opening 660 based on an application of a threshold exhale pressure sufficient for dislodging sphere component 610. Furthermore, in an aspect, exhale ballcheck duct 260 comprises a corkscrew contour referred to as inner spring-helix cavity 640 that is in-phase with spring helix component 210 for an uninterrupted stream of smoke flow. In an aspect, the corkscrew contour can gain velocity as it travels further down the spring-helix component 210.

In another aspect, detachable mouthpiece assembly 102 can comprise mouthpiece air pathway component 280 configured to provide a pathway for a user to draw smoke from (e.g., into lungs) or deliver smoke through (e.g., exhaled smoke). Also, in an aspect, mouthpiece air pathway component 280 comprises an opening on the surface of detachable mouthpiece assembly 102 and comprises a slight angled turn at vented stress point 290. In an aspect, vented stress point 290 comprises a hollow cavity that creates a stress point of air-pressure which facilitates an achievement of a threshold cracking pressure required to dislodge sphere component 610. In an aspect, sphere component 610 can be configured to create a seal with an orifice located at a bottom portion of a sloped valley portion of the exhale ballcheck valve assembly. In yet another aspect, vented stress point 290 can be configured for the achievement of a threshold cracking pressure required to flex an umbrella valve 240 or solenoid valve that allows for an influx of fresh air to a point of ignition that will be referenced throughout this disclosure.

Also, in an aspect, detachable mouthpiece assembly 102 can comprise first valve component 270 also referred to as an inhale butterfly valve. The first valve component 270 can comprise a mechanical valve which allows for an application of low-pressure for inhalation of smoke and results in a smooth inhale occurring for a user. Furthermore, in an aspect, first valve component 270 can direct smoke travelling from an inhale-filter of device 100D to travel perpendicularly towards an inhale pathway within device 100A. In a non-limiting embodiment, the inhale pathway can facilitate a direct stream of smoke to pass through first valve component 270 (e.g., a petal valve) into contoured smoke propagation cavity 630 and out mouthpiece airway pathway component 280. In an aspect, the inhale pathway can diverge from an exhale pathway of the device at a component that represents an interface for respective inhale and exhale valves, where in an aspect, common assemblies they both interact with is contoured smoke propagation cavity 630 and mouthpiece air pathway component 280. In another aspect, detachable mouthpiece assembly 102 can comprise holder component 110 which can be a ribbed conical cigarette holder configured to form a sealant coating around an orifice of first cavity portion of device 100D.

In another aspect, device 100D can comprise spring-helix holding chamber 273 that can act as a housing for various components such as spring-helix component 210. In an aspect, spring-helix component 210 which can be a spring comprised of a compressible material to facilitate lung-enabled compression of the spring. Furthermore, in one or more non-limiting embodiments, spring-helix component 210 can be comprised of one or more high temperature resistant materials and/or compressible materials such as silicone, glass, ceramic, and/or polyetherimide. In yet another aspect, spring-helix component 210 can contract longitudinally, upon air pressure created from an inhalation (e.g., from user lungs), along with an attached lighter shuttle assembly 220 allowing contact of the end of smoking media item 112 with a set of arc lighter terminals 440 (illustrated in FIG. 1F) of device 100A.

In another aspect, spring-helix holding chamber 273 can comprise spring-helix holder slip portion 202 configured to allow for a connection of a top end piece portion of spring-helix component 210 to spring-helix fastening plate component 204. In an aspect, spring-helix holder slip portion 202 can also provide an airtight seal between holder component 110, spring-helix fastening plate component 204, and spring-helix component 210 to facilitate an optimal compression capability of spring-helix component 210. In an aspect, spring-helix holding chamber 273 can comprise spring-helix fastening plate component 204 configured to create structure for a removable inlet portion of detachable mouthpiece assembly 102 upon insertion of detachable mouthpiece assembly 102 into a first cavity portion of device 100D. In another aspect, spring-helix fastening plate component 204 can include a smooth surface that allows for a stable and flush mounting spring-helix component 210. Furthermore, in an aspect, spring-helix fastening plate component 204 can be mounted into the top portion of a shuttle rail system that can lines the inner walls of spring-helix holding chamber 273. In an aspect, the shuttle rail system can be connected to the inner walls of spring-helix holding chamber 273.

In yet another aspect, spring-helix holding chamber 273 can comprise arc lighter housing component 214 (e.g., a portion above lighter shuttle assembly 220) that can be at least partially inserted within a lower portion of spring-helix component 210. In an aspect, arc lighter housing component 214 can comprise a multi-component sub-assembly that includes a thermally resistant ceramic plate (e.g., ceramic hot plate 460 illustrated in FIG. 1F) and metallic arc terminal tips (e.g., set of arc terminals 440 illustrated in FIG. 1F) that are capable of creating an electrical gap for ignition (e.g., to ignite the tip of smoking media item 112). Furthermore, in an aspect, arc lighter housing component 214 can comprise an igniter air-inlet pathway orifice (e.g., igniter air-inlet tunnel 212) for air (e.g., oxygen) delivery.

In another aspect, ignition chamber assembly 275 can be a region of device 100D that houses the ignition components configured to ignite smoking media item 112. In an aspect, ignition chamber assembly 275 can comprise arc lighter housing component 214 (e.g., a portion that lies below lighter shuttle assembly 220). Furthermore, ignition chamber assembly 275 can comprise igniter air-inlet tunnel 212 that directs injected air from umbrella valve 240 into a central ignition point or region of a set of arc lighter terminals 440 and smoking media item 112. In another aspect, ignition chamber assembly 275 can comprise umbrella valve 240 comprising an elastic one-way airflow valve that opens upon application of a threshold cracking pressure caused by airflow inhaled through external air-inlet orifice 222. In an aspect, external air-inlet orifice can be an open cutout that passively allows a fresh air-supply to enter device 100D or can facilitate an intake of fresh air-supply based on a pulling force from an inhalation event applied to device 100D.

In yet another aspect, ignition chamber assembly 275 can comprise lighter-shuttle fastening plate 208 can be configured as a top clamp to lighter shuttle assembly 220 within a lower portion of spring-helix component 210, where a lower clamp to lighter shuttle assembly 220 can be lighter-shuttle chassis 206. In another aspect, lighter-shuttle fastening plate 208 can allow for a smooth, stable, and fluid movement of lighter shuttle assembly 220 as spring-helix component 210 (e.g., comprising silicone material) compresses and expands based on airflows from inhalation and exhalation forces that instigate such airflows. Furthermore, a compression and expansion of spring-helix component 210 can allow for an ignition of varying sized smoking media item 112. In another aspect, lighter-shuttle fastening plate 208 can comprise one or more pegs to hold and sustain tension to maintain a "squeezed" state required for a clamping effect around lighter shuttle assembly 220 within spring-helix component 210.

In yet another aspect, ignition chamber assembly 275 can comprise lighter shuttle assembly 220 configured as a plate and rivet system capable of creating an air-tight seal (e.g., inhibits leakage of air) between the silicone spring-helix component 210 and internally and externally attached components. Furthermore, in an aspect, lighter shuttle assembly 220 can be configured as a silicone molded end piece of spring-helix component 210 configured to attach electrical systems (e.g., to facilitate occurrence of ignition), aeration and oxygenation systems (e.g., to facilitate airflow that allows for smoke movement within the device 100D as well as ignition activities), and rail securement systems (e.g., to securely affix lighter shuttle assembly 220 and components to ignition chamber assembly 275 and/or spring-helix holding chamber 273. In yet another aspect, lighter shuttle assembly 220 can include a connection tunnel to smoke exhaust component 230 which acts as an internal smoke leak pathway that facilitates the exhausting or propagation of smoke (e.g., in need of filtration such as exhaled smoke) from ignition chamber assembly 275 to cyclonic filter assembly 277 based on an exhalation event (e.g., by a user). Also, in an aspect, smoke exhaust component 230 can facilitate a transmission of a smoke stream having sub-micron particulates and larger mass ash residue into cyclonic filter assembly 277 to achieve a first stage of filtration of exhaled smoke.

In another aspect, ignition chamber assembly 275 can comprise lighter-shuttle chassis component 206 to allow for an inclusion of a valve system comprising umbrella valve 240 and shuttle chassis valve insert 258 to the other components of ignition chamber assembly 275. In another aspect, lighter-shuttle chassis component 206 can provide structural support to other components of ignition chamber assembly 274 (e.g., lighter shuttle assembly 220, umbrella valve 240, and spring-helix component 210) resulting in a secure attachment of lighter-shuttle chassis component 206 to lower portion of shuttle rail assembly 262. In another aspect, lighter-shuttle chassis component 206 can align lighter shuttle assembly 220 with smoke exhaust component 230 in order to facilitate a flow of exhaled smoke in need of filtration through spring-helix component 210 and through an appropriately aligned smoke exhaust component 230. Furthermore, in an aspect, umbrella valve 240 in shuttered position forms a barrier to facilitate the exhaled smoke into smoke exhaust component 230. In an aspect, the flow of exhaled smoke can be directed laterally across smoke exhaust component 230 and into a wall of cyclonic filter component 234 based on the aligned enclosure formed by lighter-shuttle chassis component 206. In another aspect, inhaled airflow can be directed longitudinally from external air-inlet orifice 222 through an opening created by an open umbrella vale 240 (pressured open via a satisfying a threshold cracking point from inhaled air), then through lighter air-inlet tunnel 212, and within spring-helix component 210 and into mouthpiece air pathway component 280.

In another aspect, lighter-shuttle chassis component 206 can comprise valve insert portion 259 that allows for umbrella valve 240 to click or snap into a secured position resulting in an airtight seal within the lighter-shuttle chassis component 206 to house and facilitate a flow of exhaled smoke in need of filtration. Furthermore, umbrella valve 240 can be dislodged from valve insert portion 259 based on a force created above a cracking threshold from an inhalation event such that airflow on the underside of the umbrella valve 240 dislodges the umbrella valve 240 from valve insert portion 259 creating an opening for fresh air to pass through.

In yet another aspect, ignition chamber assembly 275 can comprise pressure differential surface 216 configured as an inner contour attached to the chassis and allowing for umbrella valve 240 to be aligned in phase with an inner mold design of spring-helix cavity 210. In an aspect, the customized contours, shape and design of ignition chamber assembly 275 facilitates a dynamic flow of air dependent on the lighter-shuttle assembly 220 location due to compression or elongation events of spring-helix component 210. In an aspect, ignition chamber assembly 275 can create a dynamic flow of air by facilitating an airflow and/or smoke flow to corkscrew within the structural contour of spring-helix cavity 210 to gain a threshold velocity required prior to entering cyclonic filter component 234. For instance, a smaller length cigarette may require greater compression of spring-helix component 210 therefore resulting in lighter-shuttle assembly 220 to move proximally closer to detachable mouthpiece assembly 102. As such, the airflow dynamics to cause an ignition event can be dynamically regulated by ignition chamber assembly 275 due to its contoured design despite the greater distance between the ignition chamber assembly 275 and source of airflow through external air-inlet orifice 222.

Furthermore, in an aspect, ignition chamber assembly 275 can comprise a portion of shuttle rail assemblies within spring-helix holding chamber 273 and ignition chamber assembly 275 referred to as lower portion shuttle rail assembly 262. In an aspect, lower portion shuttle rail assembly 262 can comprise inset grooves into inner walls of ignition chamber assembly 275 for a secure affixing point of lighter-shuttle assembly 220 and lighter-shuttle chassis component 206. Furthermore, in an aspect, lower portion shuttle rail assembly 262 can provide a smooth and secure capability of the lighter-shuttle assembly 220 to compress and/or decompress within the enclosure created by the spring-helix component 210. In yet another aspect, lower portion shuttle rail assembly 262 can include a lubricated surface to optimize the friction level between lower portion shuttle rail assembly 262 and attached components (e.g., lighter-shuttle assembly 220). In yet another aspect, an upper portion shuttle rail assembly can comprise inset grooves and allow for attachment of components within spring-helix holding chamber 273.

In yet another aspect, ignition chamber assembly 275 can comprise electrical interface component 264 which can be configured as a contact point (e.g., connection or affixing point) between accordion electrical route component 218 and electrical housing component 224. In an aspect, electrical housing component 224 can be configured to contain a printed circuit board (e.g., a component that supports and electrically connects electronic components of device 100D), sensor logic board (e.g., controls automatic flow sensors), battery (e.g., power source of device 100D), and other electronic components. In another aspect, accordion electrical route component 218 comprises an insulated electrical wire that supplies power to ignition chamber assembly 275. For instance, insulated electrical wire can be routed through a cavity of accordion electrical route component 218 and connect to ignition chamber assembly 275 components.

In yet another aspect, accordion electrical route component 218 can include a wire (e.g., coated silicone compressed wire) capable of withstanding tension and elongating longitudinally along an attached lighter shutter assembly 220 (e.g., accordion electrical route component 218 can be attached to lighter shutter assembly 220). In another aspect, ignition chamber assembly 275 can include an electrical housing fastening plate component 226 allowing a fastened of electrical housing component 224 to device 100D with a pressure-fit seal. Furthermore, an underside portion of fastening plate component 226 can be connected to outer sleeve component 108. In a non-limiting embodiment, lighter shutter assembly 220 can be securely fastened to the device at a mobile point by lighter shuttle fastening plate pegs 720 connected to lighter shuttle fastening plate and rive system 430. Furthermore, in an aspect, this fastening allows for lighter shutter assembly 220 to be proximally located within an extension range of accordion electrical route component 218. In another aspect, the non-mobile point is where the bottom of the shuttle is adhered to external air inlet orifice base plate 760. In another non-limiting embodiment, electrical housing fastening plate 226 can be connected to a battery element and a printed circuit board element of the device.

In an aspect, device 100D and other non-limiting embodiments disclosed herein allow for an internal air system to be connected, unified and sealed within the device (with the exception of exit nozzle component 106 and the opening of mouthpiece air pathway component 280. As such, in an aspect, ignition chamber assembly 275 can facilitate an igniting of smoking media item 112 and spring helix component 210 can capture side-stream or run-off smoke emanating from a burning end of smoking media item 112. In an aspect, spring-helix component 210 can be designed to compress (e.g., like a spring bellows) during an inhalation event (e.g., from a user through mouthpiece air pathway component 280). In another aspect, spring-helix component 210 can be comprised of BPA-free silicone to be flexible (e.g., allow for compression and expansion) and withstand high temperatures (e.g., from ignition activities, burning activities of smoking media item 112). Also, in an aspect, an assortment of valves of device 100D (e.g., umbrella valve 240, first valve component 270) are designed to have a threshold cracking pressure to open the valve based on the occurrence of inhalation events. In an aspect, first valve component 270 (e.g., a petal valve) can open prior to umbrella valve 240.

In another aspect, lighter-shuttle assembly 220 can be positioned within a bottom portion of spring helix component 210 to allow for a movement of lighter-shuttle assembly 220 based on a compression or expansion of spring helix component 210. Accordingly, lighter-shuttle assembly 220 can move towards a smoking media item 112 (e.g., cigarette) of any size, and such smoking media item 112 can be ignited or reignited at any point in its smoking cycle. Furthermore, in an aspect, smoke exhaust component 230 can be a leak path that is a molded into the spring helix component 210 to allow for a movement of exhaust component 230 along with movement of spring helix component 210 thus directing exhaled smoke stream into filtration stages within device 100D.

In a non-limiting embodiment, device 100D can include central structural column 256 configured as a structural backbone of device 100D and allows for the attachment of ignition chamber assembly 275 and cyclonic filter assembly 277 into a unified corpus and airflow system (e.g., unified airflow system via exhaust component 230). In another aspect, device 100D can include cyclonic filter assembly 277 comprising a set of components. In an aspect, cyclonic filter assembly 277 can comprise cyclonic filter component 234 configured as a filtration element that uses a velocity-based filtration method to send unwanted particulates in exhaled smoke (e.g., smoke flow including ash) outward towards the walls of the cyclonic filter component 234.

Furthermore, cyclonic filter assembly 277 can make use of centrifugal force generated by an exhalation force (e.g., from a user lungs) to facilitate an outward push of particulates towards the cyclonic filter assembly 277 walls. In an aspect, the resultant force of the smoke flow is greater when applied to particulates having a larger diameter as well as with respect to larger mass particulates within the smoke flow as compared to smaller mass and/or smaller diametric particulates. This concept follows Newton's second law of motion and the Centrifugal force equation. Thus, the first filtration stage of smoke flow performed by cyclonic filter assembly 277 most effectively eliminates particulates having a larger mass and/or diameter such as ash.

In another aspect, the ash can fall down the inner walls or internal cavity of cyclonic filter assembly 277 and into a collection area with a removable and air-sealed endcap referred to as detachable ashtray endcap component 232. In an aspect, the ash-removed smoke stream (post filtration by cyclonic filter assembly 277) can still comprise approximately ninety-eight and a half percent (98.5%) particulates remaining in such smoke stream despite having removed ninety nine percent (99%) of the mass from the smoke stream during the first filtration stage performed by cyclonic filter assembly 277. An ash-removed stream can have a great amount of velocity thus allowing for the ash-removed smoke stream to travel through the cyclone (e.g., by means of an internal column within cyclonic filter assembly 277) and into a second stage of filtration performed by electrical precipitator component 236.

In an aspect, as referenced above, detachable ashtray endcap component 232 can be a removable insert that allows for a disposal of filtered ash precipitate. In another aspect, detachable ashtray endcap component 232 can accommodate a grooved design capable of allowing a tight grip (e.g., for manual screwing and unscrewing of the endcap) for prevention of residue escape upon a movement of device 100D (e.g., in a user pocket, etc.). Furthermore, a grooved design of detachable ashtray endcap component 232 can also prevent a lingering smoke or ash smell from emanating from device 100D. In another aspect, cyclonic filter assembly 277 can comprise an ash-sediment collection portion 228 configured as an area at the bottom of cyclonic filter assembly 277 in which precipitated ash residue can accumulate. In a non-limiting example embodiment, ash-sediment collection portion 228 can collect or withstand ash-sediment from at least ten consecutive smoke sessions.

In yet another aspect, ash-removed smoke flow from a first filtration stage can move into a second filtration stage performed by electrical precipitator component 236. In an aspect, electrical precipitator component 236 can include a mesh (e.g., metal mesh) that can be positively charged. In another aspect, the metal mesh can allow for air to permeate the meshing and as air or smoke with particulates pass through the meshing, the particulates can become ionized by binding to positively charged ions present on the meshing. As a result, volatile organic compounds that make up the smoke stream, can become positively charged by passing through the mesh. These particles can now bind or be drawn into a negatively charged cylinder or electric field which captures some of these particulates. In another aspect, this second filtration stage can capture a set of particulates not captured by the first filtration stage such as mid-range sized particles. In a non-limiting example embodiment, device 100D can utilize up to 15 KV of voltage to positively charge the meshing.

In yet another aspect, cyclonic filter assembly 277 can comprise pre-filter umbrella valve component 266 configured to prevent smoke that has travelled into a third stage of filtration utilizing HEPA and carbon filtering from traveling back into cyclonic filter assembly 277 from detachable filtration assembly 104. In another aspect, pre-filter umbrella valve component 266 can prevent leakage around a central column of cyclonic filter assembly 277 and a mounting portion to which cyclonic filter assembly 277 is mounted. In another aspect, cyclonic filter assembly 277 can comprise filter pod base 820 configured to create a tight seal with an exit port of a cyclonic filter column 257 of cyclonic filter assembly 277. In another aspect, filter pod base 820 can allow for a mounting of prefilter umbrella valve component 266 and provide a location for embedding an encrypted usage tracking chip. As such a tracking chip can be embedded within the device and comprise an encrypted initial numerical value representing an unused filter. The encryption element can be utilized to identify and verify the presence or absence of a native filter within the device. Furthermore, the initial numerical value can be adjusted based on usage of the filter and upon achieving a threshold value, the filter will transmit notification data to another device of the device interface to indicate the filter needs to be changed. Furthermore, in some non-limiting embodiments, the value can be adjusted based on a set of contact pins (in connection with filter usage) to track a metric (e.g., quantity) of smoking media item 112 that has been inserted (and/or removed) over a defined time range (e.g., from the time the new filter was installed). In another aspect, a set of walls can extend from filter pod base 820 and extend along detachable filtration assembly 104.

As such, device 100D can include detachable filtration assembly 104 which can comprise a central weave peg 252. In an aspect, central weave peg 252 can comprise a large sized peg capable of imposing a threshold level of tension to a portion of HEPA media weave component 246 that is longer and less compact in order to compensate for an amount of slack created by virtue of the length of the portion of HEPA media weave component 246 that hangs upon the central weave peg 252. In another aspect, detachable filtration assembly 104 can comprise a curved smoke diffuser 254 configured as a crescent shaped barrier with pinholes that create a unique air pressure distribution such that as stream can travel through the pin-holed membrane and interface with HEPA media weave component 246 head on. Furthermore, curved smoke diffuser 254 also comprises a curved shape that allow a stream of smoke passing through the curved portion to deflect towards a set of internal walls of detachable filtration assembly 104, deflect off the set of internal walls and impact HEPA media weave component 246 within detachable filtration assembly 104 at a perpendicular angle. In an aspect, a perpindicular deflection of the stream of smoke can allow for a head-on collision of smoke particles to occur and impact HEPA media weave component 246 at maximum efficiency from outward-in flow (rather than an inward-out flow of smoke).

In an aspect, the three stages of filtration imposed by device 100D allows for an effective cleaning of smoke streams that exit device 100D that lacks odor and particulates as compared to any other filtration method. In an aspect, detachable filtration assembly 104 can comprise a set of structural weave pegs 248 configured to properly position or appropriately bend the HEPA media weave component 246 for maximum airflow or smoke stream to contact a greater exposed surface area of the HEPA media weave component 246. In an aspect, the HEPA media weave component 246 can overlay over or be skewered by the set of structural weave pegs 248. Also, set of structural weave pegs 248 can pinch a small portion of the HEPA media weave component 246 (e.g., HEPA weave fabric) into the peg creases to create a secure positioning of the HEPA media weave component 246 such that movement or jostling of device 100D will not dislodge the HEPA media weave component 246 from the peg positioning.

Furthermore, in an aspect, detachable filtration assembly 104 can comprise HEPA media weave component 246 configured as HEPA weave folds in a range of styles such as a V-bank style filter. In an aspect, HEPA media weave component 246 can be configured to fold around set of structural weave pegs 248 to maximize the surface area capable of absorbing particulate in smoke as well as minimize pressure loss through each fold. In another non-limiting example embodiment, HEPA media weave component 246 can be HEPA glass-fiber media that is ranked on a MERV scale with a higher MERV (Minimum Efficiency Reporting Value) rating than other materials and accordingly allow for a higher impaction rate (e.g., absorption) of micron-sized particles into the HEPA glass-fiber media. In an instance, the HEPA glass-fiber media as HEPA media weave component 246 can be more efficient than other materials in trapping airborne particles in the smoke. In an aspect, HEPA media weave component 246 can be characterized as a third stage of smoke filtration to remove particulates from the smoke.

In yet another aspect, detachable filtration assembly 104 can comprise activated carbon component 244. In an aspect, activated carbon component 244 can act as a fourth stage of filtration such that activated carbon component 244 comprise a mixture of activated carbon pellets (e.g., sticks, spheres, other granule assortment, etc.) within an activated carbon compartment. In an aspect, the activated carbon pellets can filter the remaining smoke stream through the process of adsorption in which the particulates can adhere to the internal chasms of the activated carbon pellet. Furthermore, in an aspect, the fourth stage of filtration can be highly effective in capturing sub-micron particulates.

In another aspect, detachable filtration assembly 104 can comprise extended HEPA media component 242. In an aspect, extended HEPA media component 242 can comprise a thinner and less compact organization of HEPA media fabric capable of minimizing pressure loss from filtration activities performed at an earlier stage of filtration by the HEPA media weave component 246. In another aspect, extended HEPA media component 242 can perform filtration operations on smoke in connection with curved smoke diffuser 254, such that cured smoke diffuser 254 can transmit head on smoke (e.g., from a central column of cyclonic filter component 234) through pinholes in the curved diffuser.

In another aspect, detachable filtration assembly 104 can be covered by removable filterpod endcap component 238 configured to cover the filter pod cavity to lock in place detachable filtration assembly 104 once a pod has been inserted into second cavity portion of device 100D. Furthermore, removable filterpod endcap component 238 can redirect a flow of smoke into a perpendicular direction such that a final exhaust of filtered smoke travels through exit nozzle component 104 away from a user face and doesn't push back towards a user mouth or nose. In another aspect, removable filterpod endcap component 238 acts as a protective covering that seamlessly fits onto device 100D and completes a continuous shell design of the outer cover of device 100D. In yet another aspect, detachable filtration assembly 104 can be inserted and removed to change out filters after several uses and excessive soiling of filter components (e.g., HEPA media weave component 246, activated carbon component 144, etc.). In an aspect, detachable filtration assembly 104 can clip into second cavity portion of device 100D via a set of clips on internal side walls of detachable filtration assembly 104. For instance, upper filter clip hook 239 and lower filter clip hook 241 create a secure holding mechanism by which detachable filtration assembly 104 can clip within for user friendly insertion and removal.

In a non-limiting example embodiment, device 100D can comprise a filtration system comprising four stage sub-assemblies. The rationale behind employing a four-stage filtration system is to separate a smoke stream and filter such smoke stream to eliminate greater particle sizes ($10^{-4}$ Meter diameter) in early stages and smaller particle sizes ($10^{-8}$ Meter diameter) in later filtration stages. Accordingly, in a non-limiting embodiment, the filtration system can employ a single-pass method, that does not utilize an active or fan-powered filtration component (e.g., a disadvantage for other devices that require such electrical assembly, power, extra moving parts, etc.). Thus, device 100D merely requires a user to exhale through detachable mouthpiece assembly 102 in order to sufficiently push air or smoke through the entire four stage filtration system.

In another non-limiting embodiment, a small fan blade can be employed by device 100D in order to assist with the clearing of lingering smoke within an inner cavity. As such a fan blade can be electrically powered or maintain a rotational velocity based on a pressure of the smoke stream during an exhale operation by a user. Within a first stage of filtration a cyclonic separator can employ a velocity-based filtration method to generate centrifugal force within cyclonic filter component 234 to send particles outward towards the walls of the cyclone. This first stage of filtration can effectively remove larger diameter particulates better than removal of smaller diameter particles based on centrifugal forces and Newton's second law of motion in which larger mass or diameter particles such as ash can be filtered out of the smoke based on application of such forces.

In an aspect, larger particles such as ash can fall down walls of cyclonic filter component 234 into ash sediment collection portion 228 capable of removal using detachable ashtray endcap component 232. Furthermore, in an aspect, removing such larger particles at the first filtration stage can allow for a longer lifespan of the filtration components in second, third and fourth filtration stages. In an aspect, the ash-removed smoke stream exiting the first stage of filtration moves with a great amount of velocity by traveling through an internal column of cyclonic filter component 234. As such, the smoke ash removed smoke stream enters a second stage of filtration via electrical precipitator component 236 which comprises a metal mesh (e.g., mesh for air permeability), which can be negatively charged. As the smoke stream and particles pass through the ion mesh, the negatively charged ions can bind to volatile organic compounds resulting in negatively charged particles. Furthermore, in an aspect, upon passing through the mesh of electrical precipitator component 236, the positively charged particles can bind to a negatively charged cylinder 257 which captures some positively charged particles. As such, the second stage of filtration can capture mid-range particles.

Furthermore, after passing through the electrical precipitator component 236, the smoke stream can enter the third stage of filtration comprising components of detachable filtration assembly 104. Accordingly, the smoke can stream can pass through HEPA media weave component 246 comprising HEPA fabric folds similar to a V-Bank style in some non-limiting example embodiments. In an aspect, HEPA media weave component 246 can be optimized to present a maximum surface area for absorption of particles, as well as minimize pressure loss thorough each fold of HEPA media weave component 246. After passing through the third stage of filtration, the smoke stream can enter a fourth stage of filtration that includes an activated carbon component 244.

In an aspect, activated carbon component 244 can filter remaining smoke stream through the process of adsorption such that the smoke stream particulates adhere to internal chasms of activated carbon pellets. The fourth stage of filtration can be highly effective in capturing sub-micron particulates. In another non-limiting embodiment, the fourth stage of filtration can utilize a deodorizing agent, such as citric acid pellets, desiccant (e.g., moisture removal), or a scent additive to eliminate unwanted odor from the smoke stream. Furthermore, such mechanisms can remove mustiness or include a pleasant fragrance after each exhale.

In another non-limiting example embodiment, device 100D can employ a two factor authentication system to verify that only proprietary filters can be inserted within device 100D. In an aspect, a design of the insertion port (e.g., also referred to as second cavity portion) can be configured such that only target filters can effectively snap into device 100D to form a seal and complete internal airflow pathways. In another non-limiting example embodiment, device 100D can employ a chip such as a printed circuit board (PCB) as well as a contact-pin male-port molded into the corpus of the filter housing to be encrypted with a proprietary key. As such, the proprietary key can be verified upon the male contact pins interfacing firmly into a female-receiver port molded into device 100D body. Upon a proper integration of male contact pins with female-receiver port, the device 100D can recognize a proper connection occurred and utilize wireless capabilities to transmit data from the PCB to a data store (e.g., cloud network storage device such as a server). In yet another aspect, a network device can transmit a capacitive signal to the PCB of device 100D after a predetermined period of time (e.g., an average filter lifespan time period) has passed and the device is initiated. Accordingly, heavily used filters can be rendered unusable at correct periods of time to provide a layer of safety to users and device 100D.

In an aspect, detachable filtration assembly 104 can be a high efficiency filter that specifically focuses on smoke particulate filtration and odor removal. In another non-limiting embodiment, detachable filtration assembly 104 can be a stand-alone in-room unit (e.g., unit to filter air using one or more of the four stages of filtration) capable of being positioned along a three-dimensional axis to cover all corners of a room, home or larger facility (e.g., smoke lounge). In an aspect, each standalone filter can be communicatively coupled to other proprietary devices that facilitate smoke and order filtration based on detection of a location of respective devices within a three-dimensional space. As such, the stand-alone filters can feature smart-capabilities to power on and off such filter's operations based on detection of a presence of other devices within designated regions. Furthermore, such standalone filters can comprise a range of sensors to facilitate the detection, monitoring, and tracking operations of the stand-alone filters.

In other non-limiting example embodiments, device 100D can comprise one or more sensors capable of receiving data based on occurrence of various component events. For instance, a set of sensors can be employed by device 100D to monitor a functionality of system components, ensure a proprietary filter is utilized, ensure system components are functional. As an example, one or more sensor (e.g., pressure sensor) can be utilized to detect whether an appropriate male contact pin of detachable mouthpiece assembly 102 is inserted into a female port of detachable mouthpiece assembly 102. Furthermore, a sensor can detect the presence or absence of a smoking media item 112 within holder component 110. In another non-limiting aspect, a sensor can communicate with a processor of device 100D to detect and count a number of puffs a user takes (e.g., smoking habit, smoking frequency, etc.) to provide an approximation of remaining filter lifespan and communicates with processor to adjust lifespan data values accordingly associated with detachable filtration assembly 104 lifespan.

In another non-limiting embodiment, device 100D can employ a dynamic aperture to open or close a diaphragm component and intake or exhale more or less fresh air to impact an amount of draft that passes through detachable filtration assembly 104. Furthermore, a detection sensor can detect an metric associated with airflow and a transmission instruction executed by device 100D processor can transmit a notification to device 100D or other devices (e.g., smartphone, tablet, desktop computer, etc.). In other non-limiting embodiments, device 100D can employ a range of sensors, including, but not limited to, pressure sensors, weight sensors, temperature sensors, gas sensors, ambient pressure sensors, internal heat sensors, accelerometers, gyroscopes, and other such sensors.

For instance, device 100D can employ a gas sensor to detect an odor or fume particle based on smoke passing through the device 100D components or based on a user exhaling smoke into the atmosphere instead of within device 100D (e.g., an electronic nose). In another non-limiting embodiment, device 100D can employ an ambient pressure sensor configured to detect external air parameters representing an air condition of the environment. As such, device 100D can adjust a level of fresh air or oxygen into device 100D to assure a standardize influx of fresh air through an aperature or valve of device 100D.

In yet another aspect, device 100D can employ one or more heat sensors (e.g., thermistor) to facilitate a detection and tracking of heat emanating from smoking media item 112 to indicate a tracking of an ember as it burns along smoking media item 112 corpus. In the event that the lighter-shuttle assembly 220 becomes immobile (e.g., no spring compression), the heat sensor can detect the status of the smoking media item 112 and transmit (e.g., using a transmission component in connection with processor of device 100D) notification data representing a status of smoking media item 112 in its smoking cycle to another device (e.g., application executing on a mobile device).

In another non-limiting embodiment, device 100D can employ a mobile burn chamber and a motion or distance sensor that attaches to an ignition cart to track data representing a position of the cart as compared to data representing a resting position of the ignition cart, such that device 100D (e.g., using a processor) can determine (based on the comparative data) a status of a smoking media item 112 in its smoking cycle. Furthermore, in an aspect, device 100D can employ wireless technologies (e.g., Bluetooth™, beacon, NFC, or other signal transmission mechanism to facilitate wireless communication capabilities with other smart devices (e.g., mobile device, set top box, desktop computer, tablet, etc.). Furthermore, device 100D can employ an authentication component to validate that software shipped with device 100D is authentic and such authentication component can permit or prevent a synchronization of other devices with device 100D based on an authentication event.

In yet another aspect, upon a determination that device 100D is employing authentic system components (e.g., software systems), access to capabilities to monitor and control functionality of device 100D can be provided via a network connected portal hub (e.g., web portal). In another aspect, system components execution on device 100D can transmit data to an application executing on a user device (e.g., smart phone), such that a user device can be utilized to access a data store comprising device 100D information such as usage history, user log data (e.g., encrypted), smoking cycle data of a cigarette, planning data (e.g., allowing a user to track data contributing to smoke cessation), and/or other such data sets.

In another aspect, device 100D can be communicatively coupled to transmit or receive instructions or data to or from a social media tool or marketplace. Furthermore, in an aspect, social features can be accessible based upon a range of events occurring. For instance, device 100D can provide access to a social network or social circle based upon detection of a smoking event by device 100D sensors (e.g., a determination that active smoking is occurring). In another non-limiting instance, device 100D usage or execution of operations of device 100D can be coupled to a grant of tokens within an internalized or externalized token system (e.g., points, coins, cryptocurrency or other token object), such that an occurrence of various device 100D activities can be rewarded with an issuance of tokens. For instance, if a user becomes a responsible smoker as demonstrated by respective smoking habits implemented in connection with device 100D, then a user may be granted reward tokens.

As an example, a detection by device 100D of an occurrence of a pinned rate for a duration of time indicating a target exhale pressures is achieved representing a responsible decision of a user to preserve air quality of those around such user, could be granted an issuance of one or more reward token to be applied towards purchase of an item from a vendor whom accepts such token. Accordingly, tokens or points can be redeemed within a marketplace for various merchandise items or items exclusively offered in exchange for such token or points (e.g., smoking accessories). In yet another aspect, device 100D can employ a proprietary operating system that facilitates the network connectivity to other devices (e.g., stand-alone room filter) based on a positioning or arrangement of such other devices within a room.

Figure 1E:
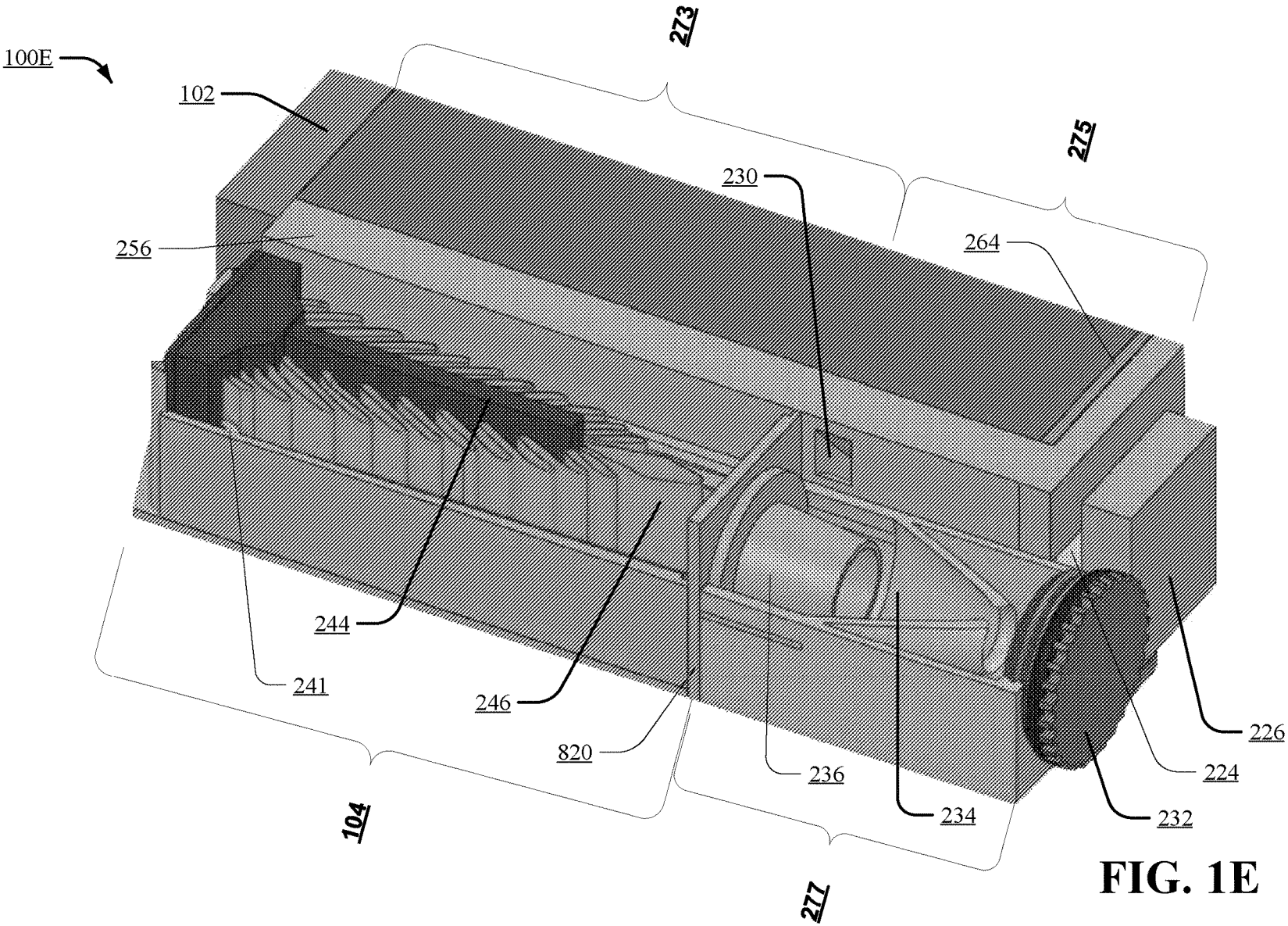
FIG. 1E illustrates a diagram of an example, external perspective view of a non-limiting smoking filtration device 100E, including but not limited to, a covered detachable mouthpiece assembly, spring-helix chamber assembly, and ignition chamber assembly, and a cross-sectional internal perspective view of an ash-catcher assembly, and detachable filtration assembly that can facilitate a filtered smoking of a smoking media item in accordance with one or more embodiments described herein.

Turning now to FIG. 1E, illustrated is a diagram of an example, external perspective view of a non-limiting smoking filtration device 100E, including but not limited to, a covered detachable mouthpiece assembly, spring-helix chamber assembly, and ignition chamber assembly, and a cross-sectional internal perspective view of an ash-catcher assembly, and detachable filtration assembly that can facilitate a filtered smoking of a smoking media item in accordance with one or more embodiments described herein. Repetitive description of like elements employed in other embodiments described herein is omitted for sake of brevity.

In an aspect, FIG. 1E provides a different perspective view of various aspects of smoking filtration device 100E including, but not limited to, detachable mouthpiece assembly 102, spring-helix holding chamber 273, ignition chamber assembly 275, detachable filtration assembly 104, cyclonic filter assembly 277, smoke exhaust component 230, electrical interface component 264, electrical housing fastening plate 226, electrical housing component 224, detachable ashtray endcap component 232, cyclonic filter component 234, electrical precipitator component 236, filter pod base 820, HEPA media weave component 246, activated carbon component 244, lower filter clip hook 241, and central structural column 256.

Figure 1F:
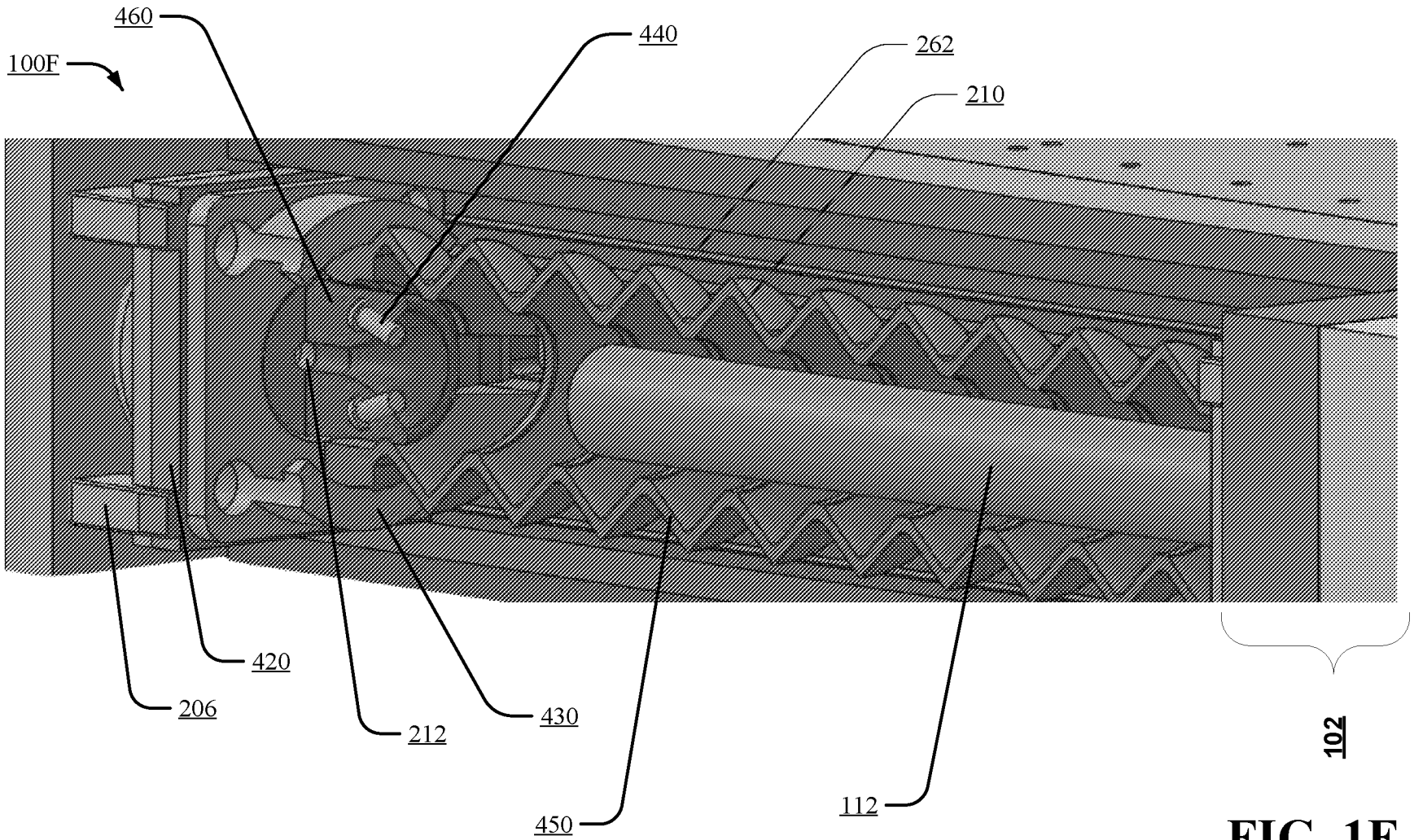
FIG. 1F illustrates a diagram of an example, closeup and internal perspective view of a non-limiting smoking filtration device 100F, including but not limited to, a spring-helix chamber assembly and an ignition chamber assembly that can facilitate a filtered smoking of a smoking media item in accordance with one or more embodiments described herein.

FIG. 1F illustrates a diagram of an example, closeup and internal perspective view of a non-limiting smoking filtration device 100F, including but not limited to, a spring-helix holding chamber assembly 273 and an ignition chamber assembly 275 that can facilitate a filtered smoking of a smoking media item in accordance with one or more embodiments described herein. Repetitive description of like elements employed in other embodiments described herein is omitted for sake of brevity.

In an aspect, smoking filtration device 100F can include, but is not limited to, ceramic hot plate 460, set of arc lighter terminals 440, lower portion shuttle rail assembly 262, detachable mouthpiece assembly 102, smoking media item 112, internal corkscrew contour 450, lighter-shuttle fastening plate and rivet system 430, igniter air inlet tunnel 212, bottom helix lighter portion 420, and lighter shuttle chassis component 206. In an aspect, ignition chamber assembly 275 can comprise ceramic hot plate 460 that provides a contact surface for a tip of smoking media item 112 to interface with set of arc terminals 440. Furthermore, in an aspect, ceramic hot plate 460 can be comprised of high temperature resistant ceramic material that acts as an electrical insulator. In another aspect, ceramic hot plate 460 can be connected to lighter-shuttle fastening plate and rivet system 430 configured to create an air tight seal (e.g., leak proof) between a silicone portions of spring-helix component 210 and surrounding components.

In yet another aspect, ignition chamber assembly 275 can comprise set of arc lighter terminals 440 configured as flat-ended terminals capable of generating a spark gap, such that a spark and flame generated in between the spark gap can be blown towards the tip of the smoking media item 112 based upon occurrence of an inhalation event. In another aspect, ignition chamber assembly 275 can comprise bottom helix lighter portion 420 configured as an end piece portion of spring-helix component 210 that is comprised of molded silicone and function as an electrical aeration and oxygenation system, and a rail securement system. In an aspect, a polycarbonate lighter-shuttle fastening plate and rivets system 430 can be fastened to bottom helix lighter portion 420. In yet another aspect, a force from an inhalation event can elongate a spring portion of bottom helix lighter portion 420 to result in an elongation of bottom helix lighter portion 420 allowing for smoking media item 112 to contact set of lighter terminals 440.

In another aspect, internal corkscrew shaped contour 450 can refer to a double helix designed internal cavity contour of a silicone spring that facilitates a smoke stream to coil around the double helix and gain velocity as it travels downward with the cavity and into the filtration components associated with the set of filtration stages of device 100D. In another aspect, ignition chamber assembly 275 can comprise igniter air-inlet tunnel 212 can be configured as an opening that allows for a flow of fresh air (e.g., oxygen) to flow directly to a point of ignition between set of lighter terminals 440 of device 100D. Furthermore, air-inlet tunnel 212 can create a central minimum area for air to flow and create a pressure differential upon occurrence of an inhalation event. The pressure differential can drive a movement of lighter-shuttle chassis component 206 towards smoking media item 112. In an aspect, lighter-shuttle chassis component 206 can comprise a structural support for a secure attachment of the shuttle assembly to lower portion shuttle rail assembly 262. Furthermore, lighter-shuttle chassis component 206 can align the lighter shuttle assembly with the smoke exhaust port or exhaust nozzle component 106. In yet another aspect, lighter-shuttle chassis component 206 can allow for an attachment of valve systems (e.g., umbrella valve 240) to the other components of lighter-shuttle chassis component 206

Figure 1G:
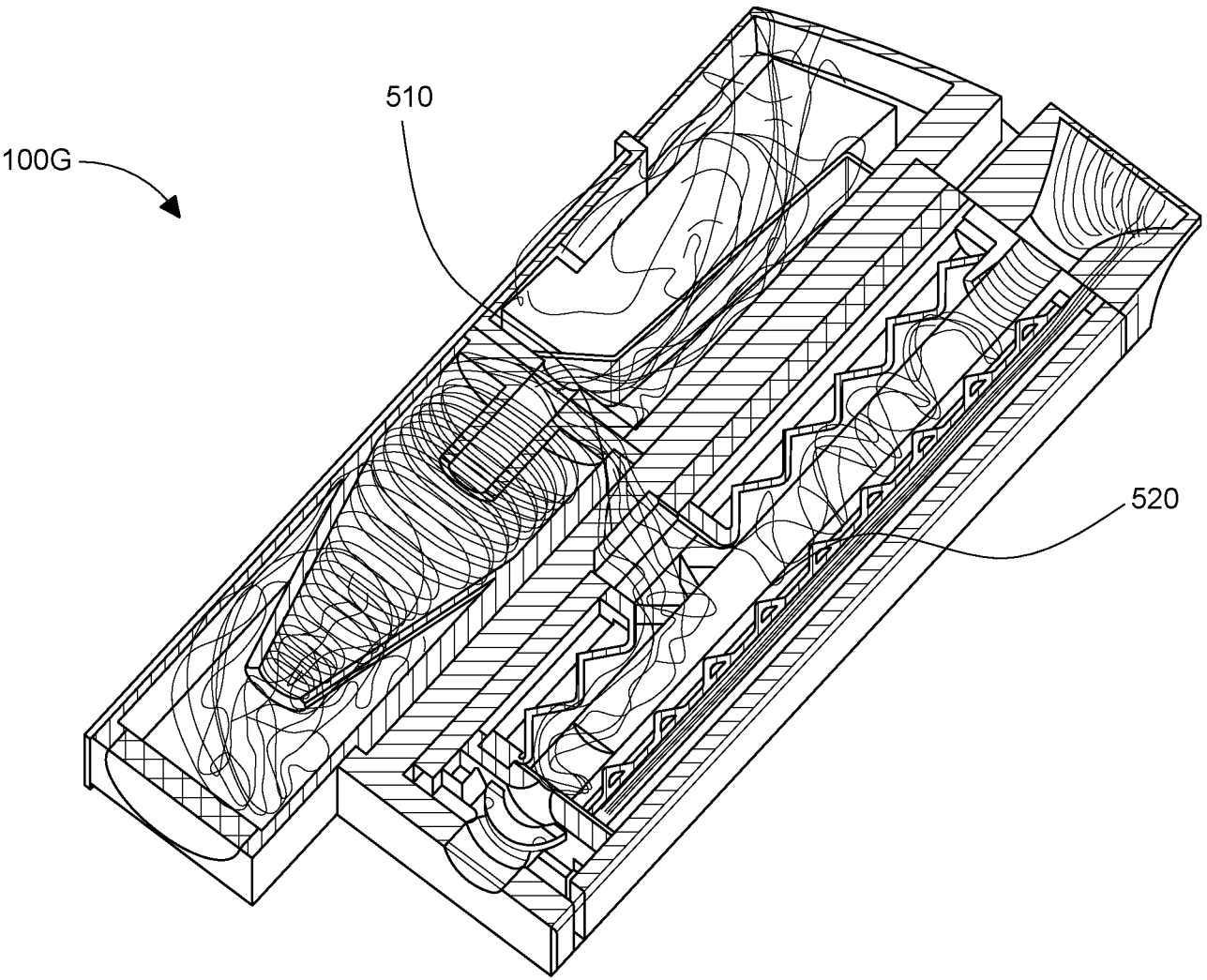
FIG. 1G illustrates a diagram of an example, closeup and internal perspective view of a non-limiting smoking filtration device 100G, including but not limited to, a heatmap exemplifying the velocity of smoke that travels throughout various inner cavities of the device that can facilitate a filtered smoking of a smoking media item in accordance with one or more embodiments described herein.

FIG. 1G illustrates a diagram of an example, closeup and internal perspective view of a non-limiting smoking filtration device 100G, including but not limited to, a heatmap exemplifying the velocity of smoke that travels throughout various inner cavities of the device that can facilitate a filtered smoking of a smoking media item in accordance with one or more embodiments described herein. Repetitive description of like elements employed in other embodiments described herein is omitted for sake of brevity.

In an aspect, FIG. 1G illustrates locations within device 100G that can have variations in airflow velocity. In general, areas where the lowest airflow velocity occur can present the highest-pressure resistance. In an aspect, the device is configured to allow for an optimal airflow to occur prior to the smoke or airflow reaching a filtration stage which presents the highest airflow/smoke flow resistance. Thus the optimal airflow can be a high pressure airflow that is great (greater than or equal to a threshold resistance level) enough to overcome the resistance presented at each filtration stage. At reference numeral 510, an area of high velocity leak path flow is shown. In an aspect, this can be a point of highest velocity that results from an application of exhale pressure (e.g., from a user exhaling) and air flow coiling velocity effect from internal corkscrew shaped contour 450. At reference numeral 520, an area of coiling internal exhale flow is illustrated. In an aspect, the velocity effect from the internal corkscrew shaped contour 450 can facilitate a scrubbing of ash from around a smoking media item 112 upon occurrence of an exhalation event by a user.

Figure 1H:
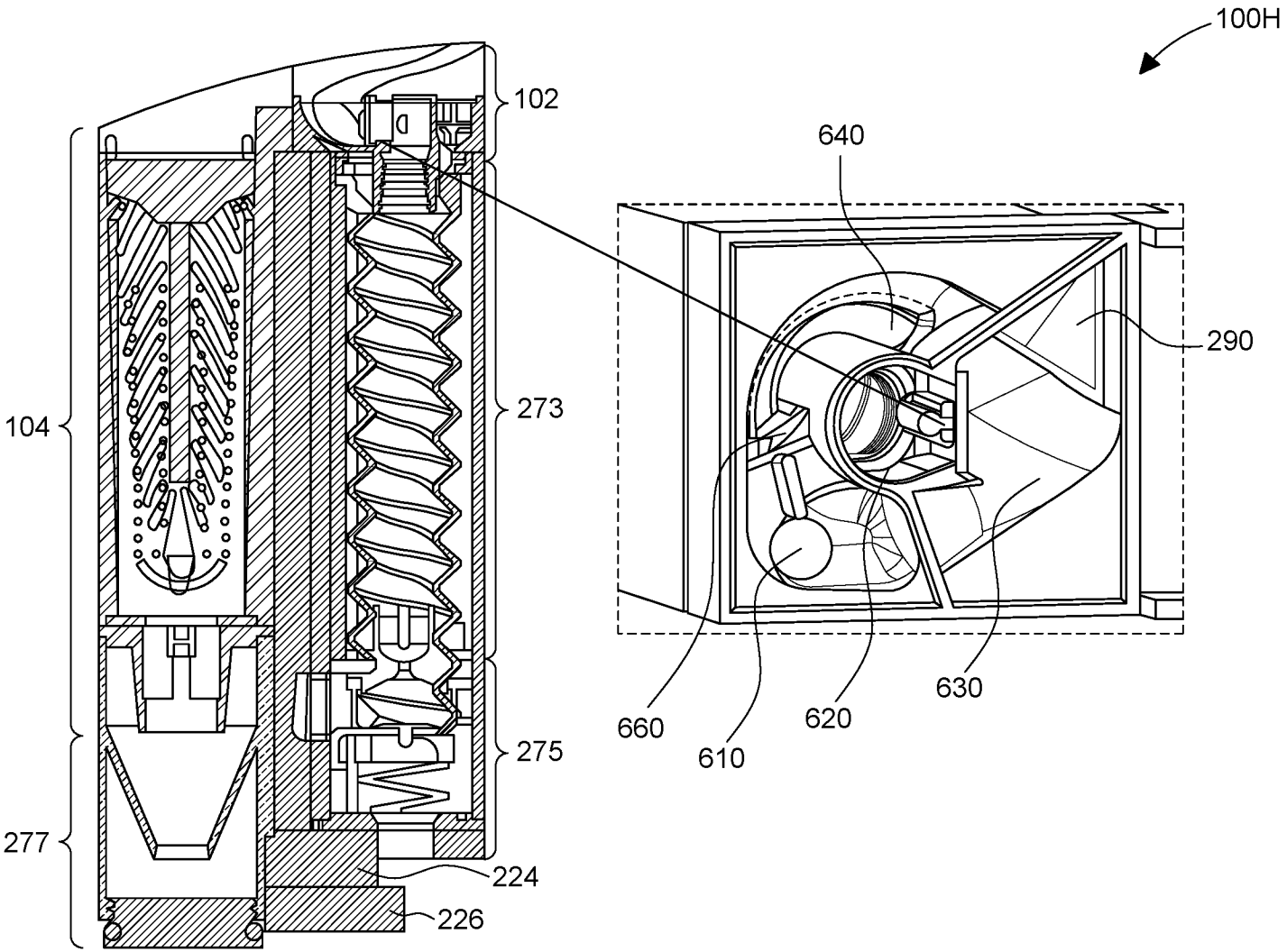
FIG. 1H illustrates a diagram of an example, cross-sectional, internal perspective view of a non-limiting smoking filtration device 100H, including but not limited to, a detachable mouthpiece assembly, a spring-helix chamber assembly, an ignition chamber assembly, detachable filtration assembly, and ash-catcher assembly as well as a closeup view of a portion of the detachable mouthpiece assembly that can facilitate a filtered smoking of a smoking media item in accordance with one or more embodiments described herein.

FIG. 1H illustrates a diagram of an example, cross-sectional, internal perspective view of a non-limiting smoking filtration device 100H, including but not limited to, a detachable mouthpiece assembly 102, a spring-helix holding chamber assembly 273, an ignition chamber assembly 275, detachable filtration assembly 104, and cyclonic filter assembly 277 as well as a closeup view of a portion of the detachable mouthpiece assembly that can facilitate a filtered smoking of a smoking media item in accordance with one or more embodiments described herein. Repetitive description of like elements employed in other embodiments described herein is omitted for sake of brevity.

In an aspect, device 100H can include detachable mouthpiece assembly 102, ignition chamber assembly 275, detachable filtration assembly 104, cyclonic filter assembly 277, electrical housing component 224, electrical housing fastening plate 226, inner spring helix cavity 640, vented stress point 290, ballcheck exhale duct opening 660, exhale ballcheck valve component 610, central inhale route 620, and contoured smoke propagation cavity 630. In an aspect, detachable mouthpiece assembly 102 can comprise inner spring-helix cavity 640 configured as an in-phase alignment that is contoured as a silicon helix portion of spring-helix component 210 that interfaces with detachable mouthpiece assembly 102. In an aspect, inner spring-helix cavity 640 can connect to ballcheck exhale duct opening 660 upon dislodging of sphere component 610. In another aspect, vented stress point 290 can comprise a hollow cavity that creates a stress point of air pressure that allows for the achievement of pressure capable of dislodging sphere component 610. In another aspect, vented stress point 290 can facilitate a funneling of smoke mechanism to generate extra positive pressure to aid the movement of air (e.g., airflow) within detachable mouthpiece assembly 102.

In another aspect, detachable mouthpiece assembly 102 can comprise central inhale route 620 configured as a hollow cylinder port capable of transporting inhaled smoke directly from an inhale filter component. In an aspect, the inhale filter component can be a cotton, carton (e.g., hand-rolled) or other style filter (e.g., corn husk) that is part of a smoking media item 112. In yet another aspect, detachable mouthpiece assembly 102 can comprise contoured smoke propagation cavity 630 that acts as a smooth surface preventing residue from adhering to the walls of respective valves within detachable mouthpiece assembly 102. Furthermore, in an aspect, contoured smoke propagation cavity 630 can comprise curves that aggregate individual smoke streams into unified channels of smoke streams for efficient and smooth inhalation. In another aspect, detachable mouthpiece assembly 102 can comprise ballcheck exhale duct opening 660 configured to provide an exit path for exhaled smoke once a ballcheck cracking threshold has been achieved. In another aspect, ballcheck exhale duct opening 660 can transmit some streams in-phase with a helical contour of other components.

Figure 1I:
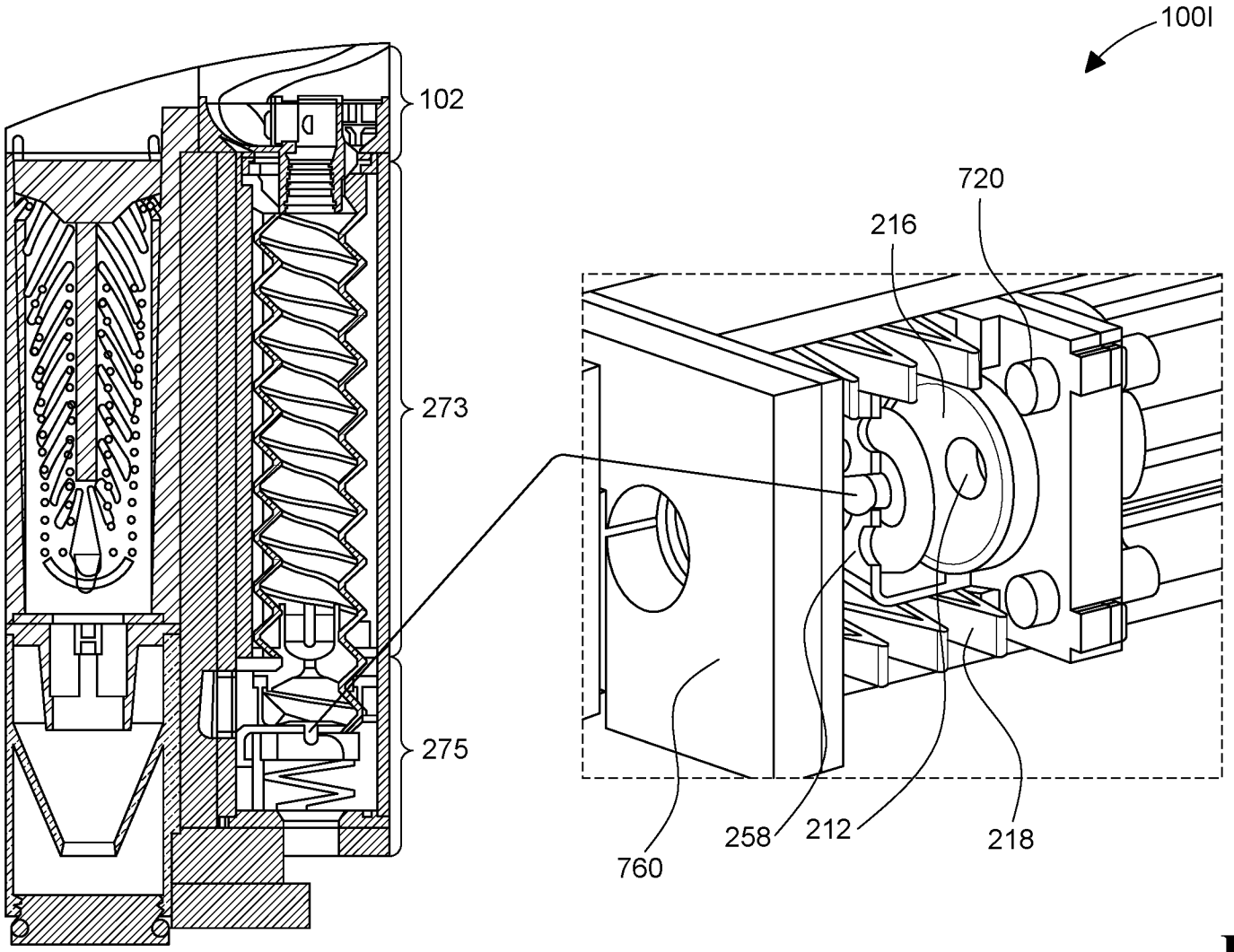
FIG. 1I illustrates a diagram of an example, cross-sectional, internal perspective view of a non-limiting smoking filtration device 100I, including but not limited to, a detachable mouthpiece assembly, a spring-helix chamber assembly, an ignition chamber assembly, detachable filtration assembly, and ash-catcher assembly as well as a closeup view of a portion of the ignition chamber assembly that can facilitate a filtered smoking of a smoking media item in accordance with one or more embodiments described herein.

FIG. 1I illustrates a diagram of an example, cross-sectional, internal perspective view of a non-limiting smoking filtration device 100I, including but not limited to, a detachable mouthpiece assembly, a spring-helix chamber assembly, an ignition chamber assembly, detachable filtration assembly, and ash-catcher assembly as well as a closeup view of a portion of the ignition chamber assembly that can facilitate a filtered smoking of a smoking media item in accordance with one or more embodiments described herein. Repetitive description of like elements employed in other embodiments described herein is omitted for sake of brevity.

In another aspect, device 100I can comprise detachable mouthpiece assembly 102, spring-helix holding chamber 273, ignition chamber assembly 275, pressure differential surface 216, lighter shuttle fastening plate pegs 720, cyclonic filter assembly 277, detachable filtration assembly 104, accordion electrical route component 218, igniter air-inlet tunnel 212, valve insert portion 258, and external air-inlet orifice base plate 760. In an aspect, ignition chamber assembly 275 can comprise pressure differential surface 216 configured as an inner contour attached to lighter-shuttle chassis component 206 and allows for umbrella valve 240 to be in phase with an inner mold design of with the bottom surface of bottom helix lighter portion 420. In another aspect, the contour design of pressure differential surface 216 is configured to allow for a regulated dynamic flow air that is dependent on the location of lighter-shuttle chassis component 206 (e.g., capable of movement as spring-helix component 210 compresses). In another aspect, ignition chamber assembly 275 can comprise lighter-shuttle fastening plate pegs 720 configured as fasteners to claim the compressible silicone bottom helix lighter portion 420 between lighter-shuttle fastening plate and rivet system 430 and lighter-shuttle chassis component 206. In another aspect, lighter-shuttle fastening plate pegs 720 can hold and sustain a tension to keep bottom helix lighter portion 420 in a squeezed state to maintain a complete seal between the sandwiched components.

In another aspect, ignition chamber assembly 275 can comprise igniter air-inlet tunnel 212 that allows for an intake of fresh air or oxygen directly to the point of ignition. Furthermore, in an aspect, by creating a central minimum air flow, igniter air-inlet tunnel 212 can create a pressure differential upon occurrence of an inhalation event (by a user). The inhalation event and resultant pressure differential can drive movement of lighter-shuttle chassis component 206 towards smoking media item 112. In another aspect, ignition chamber assembly 275 can comprise valve insert portion 258 that can be configured as part of lighter-shuttle chassis component 206 and allow for umbrella valve 240 to click into a secure position within valve insert portion 258 and form an airtight seal (thus allowing for exhaled smoke stream to travel into the filtration components of device 100I).

In yet another aspect, ignition chamber assembly 275 can comprise accordion electrical route component 218 configured as an insulated electrical wire capable of supplying power to ignition chamber assembly 275. Furthermore, accordion electrical route component 218 can act as a coated silicone compressed wire capable of withstanding tension and capable of elongating longitudinally along lighter-shuttle chassis component 206 to which it is attached. In yet another aspect, ignition chamber assembly 275 can comprise external air-inlet orifice base plate 760 configured to act as a mount to electrical interface component 264. In another aspect, external air-inlet orifice base plate 760 can act as a passively open cutout portion of the device to allow an intake of airflow within the internal cavities of device 100I.

Figure 1J:
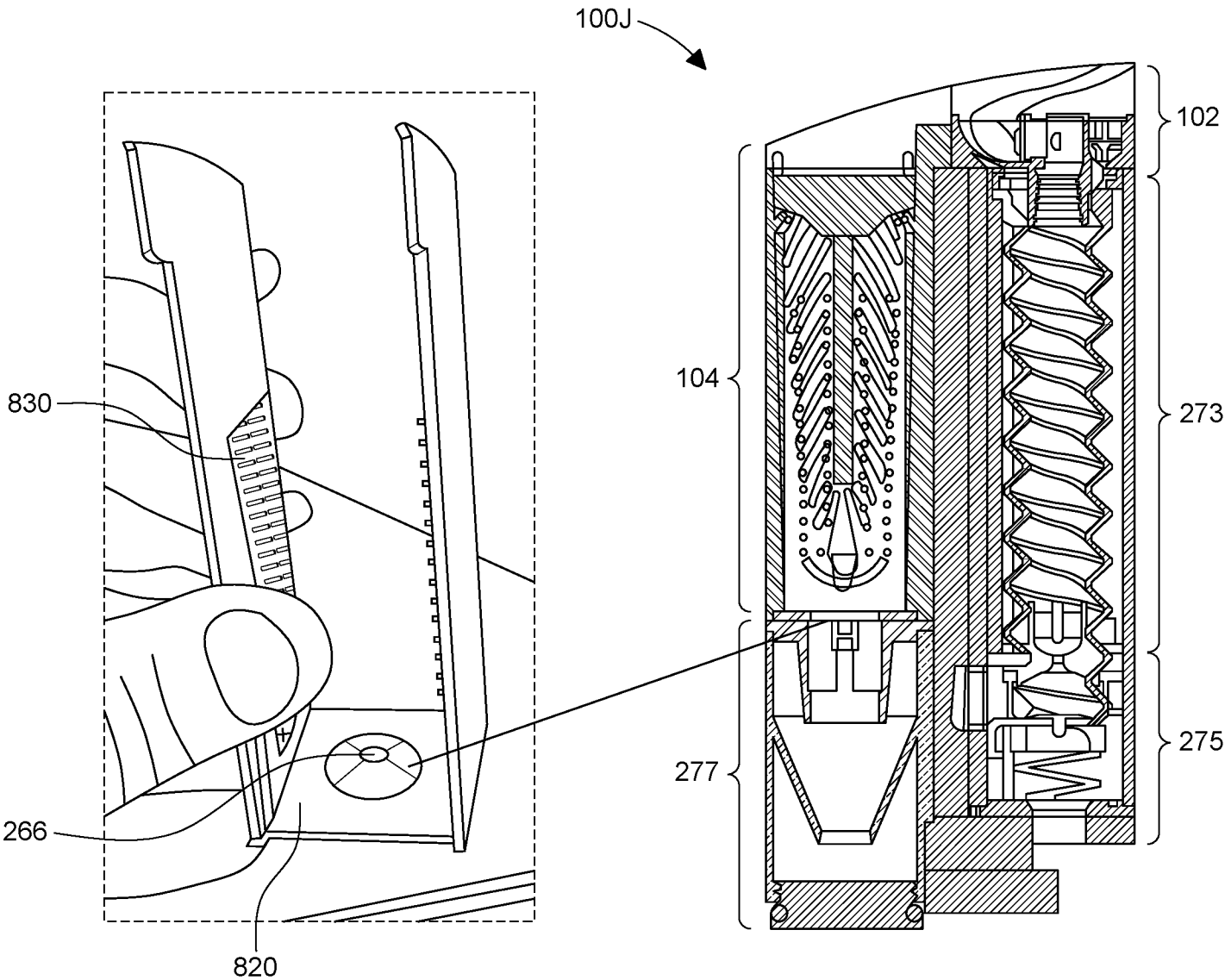
FIG. 1J illustrates a diagram of an example, cross-sectional, internal perspective view of a non-limiting smoking filtration device 100J, including but not limited to, a filtration pod holding chamber that can hold the detachable filtration pod and can facilitate a filtered smoking of a smoking media item in accordance with one or more embodiments described herein.

FIG. 1J illustrates a diagram of an example, cross-sectional, internal perspective view of a non-limiting smoking filtration device 100J, including but not limited to, a filtration pod holding chamber that can hold the detachable filtration pod and can facilitate a filtered smoking of a smoking media item in accordance with one or more embodiments described herein. Repetitive description of like elements employed in other embodiments described herein is omitted for sake of brevity.

In another aspect, device 100J can comprise detachable mouthpiece assembly 102, spring-helix holding chamber 273, ignition chamber assembly 275, cyclonic filter assembly 277, detachable filtration assembly 104, filter pod base 820, set of pinholes and grooves 830, and pre-filter umbrella valve component 266. In an aspect, cyclonic filter assembly 277 can comprise pre-filter umbrella valve component 266 that can be configured to trap smoke within detachable filtration assembly 104 and prevent such smoke from flowing backward into cyclonic filter assembly 277 upon an inhalation event (e.g., by a user). In an aspect, pre-filter umbrella valve component 266 can be located at the exit region of a central column of cyclonic filter assembly 277. In another aspect, detachable filtration assembly 104 can comprise set of pinholes and grooves 830 along a non-detachable portion of detachable filtration assembly 104. In an aspect, set of pinholes and grooves 830 can be attached to walls that are connected to and run perpendicular to filter pod base 820. In an aspect, set of pinholes and grooves 830 can act as pinhole extrusions along the walls of filter pod capable of receiving inserted portions of HEPA media weave component 246. Furthermore, in an aspect, set of pinholes and grooves 830 can act as grooves to skewer a small quantity of HEPA media weave component 246 to contribute to a structural rigidity of the HEPA media weave component 246. Furthermore, in an aspect, set of pinholes and grooves 830 can receive set of structural weave pegs 248 within such pinhole and grooves 830.

Figure 1K:
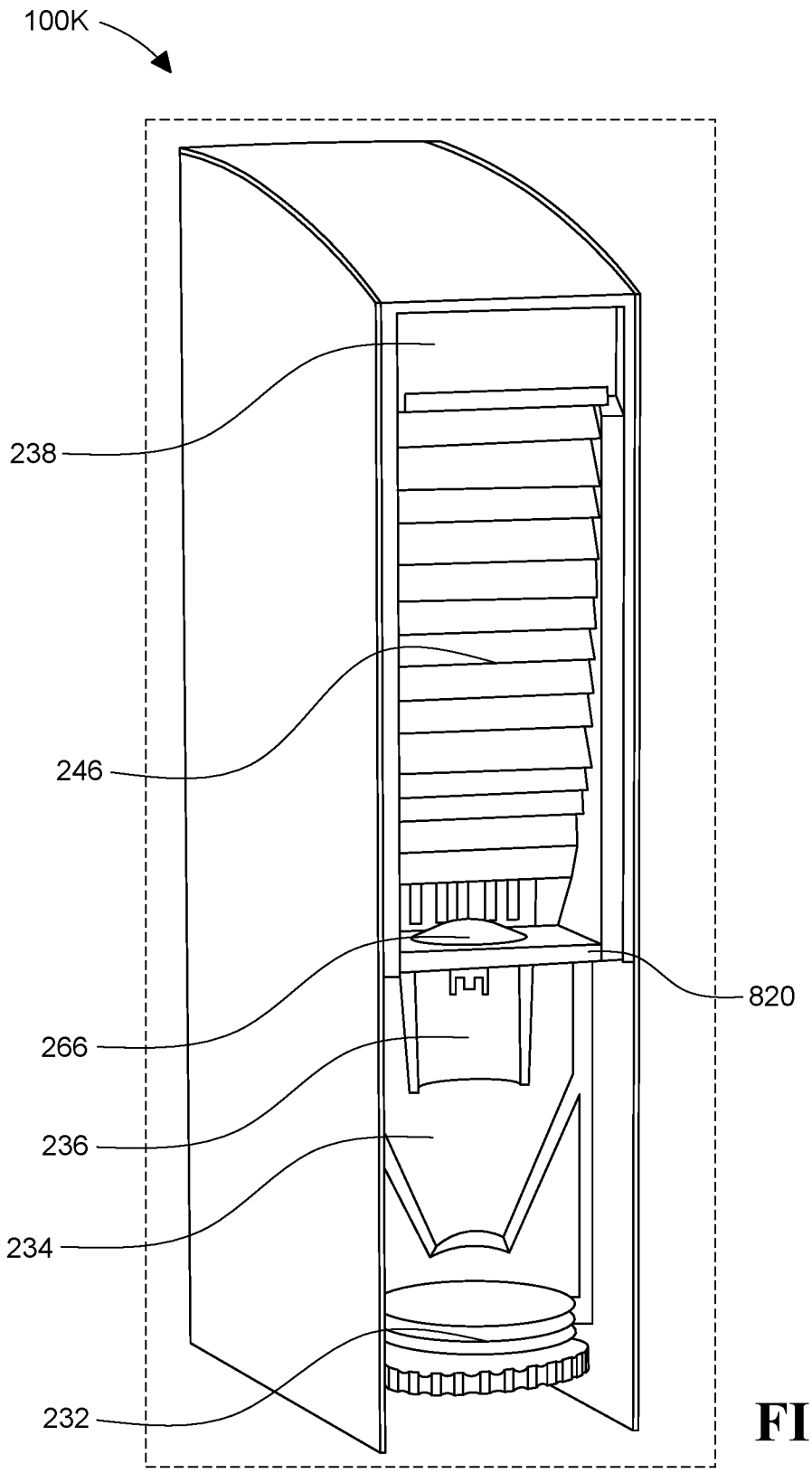
FIG. 1K illustrates a diagram of an example, closeup perspective view of a non-limiting smoking filtration device 100K, including but not limited to, a filtration pod holding chamber that can hold the detachable filtration pod and cyclonic filter assembly that can facilitate a filtered smoking of a smoking media item in accordance with one or more embodiments described herein.

FIG. 1K illustrates a diagram of an example, closeup perspective view of a non-limiting smoking filtration device 100K, including but not limited to, a filtration pod holding chamber that can hold the detachable filtration pod and cyclonic filter assembly that can facilitate a filtered smoking of a smoking media item in accordance with one or more embodiments described herein. Repetitive description of like elements employed in other embodiments described herein is omitted for sake of brevity.

In another aspect, device 100K illustrates a closeup and cross-sectional view of cyclonic filter assembly 277 and detachable filtration assembly 104. In an aspect, device 100K illustrates removable filterpod endcap component 238, HEPA media weave component 246, pre-filter umbrella valve component 266, electrical precipitator component 236, cyclonic filter component 234, detachable ashtray endcap component 232, and filter pod base 820.

Figure 1L:
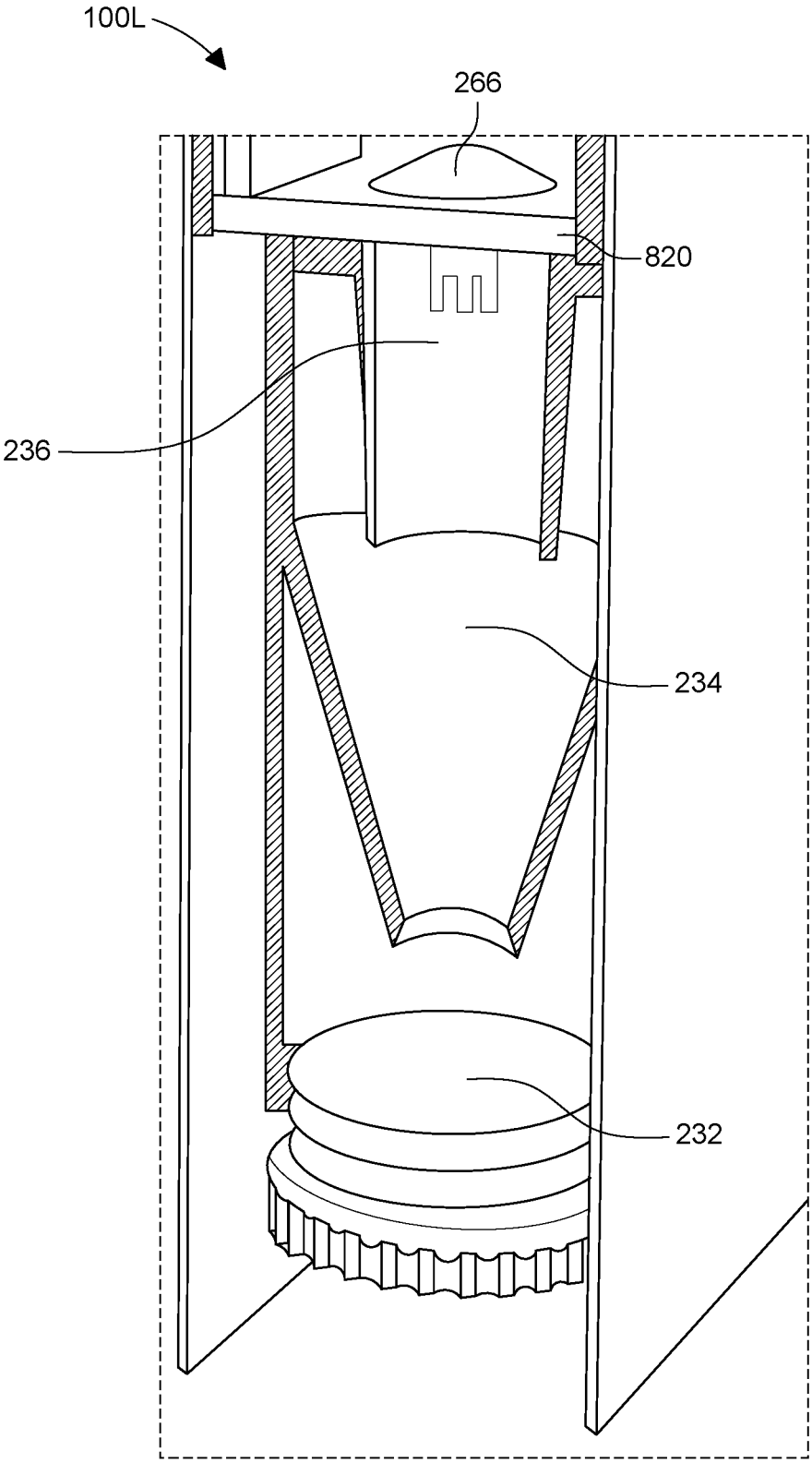
FIG. 1L illustrates a diagram of an example, closeup perspective view of a non-limiting smoking filtration device 100L, including but not limited to, a cyclonic filter assembly that can facilitate a filtered smoking of a smoking media item in accordance with one or more embodiments described herein.

FIG. 1L illustrates a diagram of an example, closeup perspective view of a non-limiting smoking filtration device 100L, including but not limited to, a cyclonic filter assembly that can facilitate a filtered smoking of a smoking media item in accordance with one or more embodiments described herein. Repetitive description of like elements employed in other embodiments described herein is omitted for sake of brevity.

In another aspect, device 100L illustrates a closeup and cross-sectional view of cyclonic filter assembly 277. In an aspect, device 100L illustrates pre-filter umbrella valve component 266, electrical precipitator component 236, cyclonic filter component 234, detachable ashtray endcap component 232, and filter pod base 820.

Figure 1M:
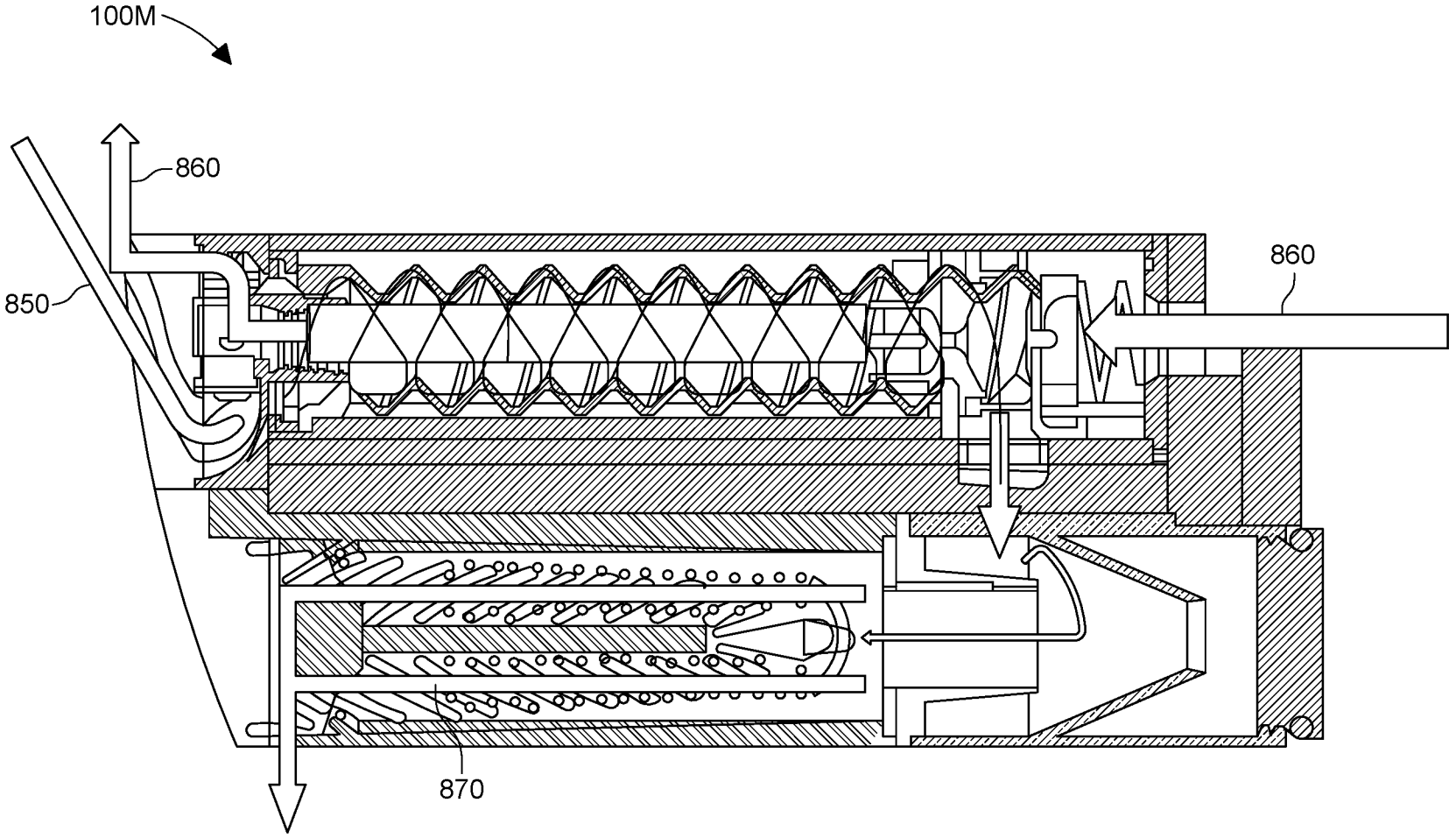
FIG. 1M illustrates a diagram of an example, closeup perspective view of a non-limiting smoking filtration device 100M, including but not limited to, a set of smoke flows capable of traveling throughout the device 100M in accordance with one or more embodiments described herein.

FIG. 1M illustrates a diagram of an example, closeup perspective view of a non-limiting smoking filtration device 100M, including but not limited to, a set of smoke flows capable of traveling throughout the device 100M in accordance with one or more embodiments described herein. Repetitive description of like elements employed in other embodiments described herein is omitted for sake of brevity.

In an aspect, FIG. 1M illustrates various smoke flows including stream of exhaled secondhand smoke 850 (also referred to as first exhale pathway 850), inhaled smoke stream 860 (also referred to as inhale pathway 860), filtered smoke exhaust 870, and fresh air intake stream 880. In an aspect, device 100M has several separated flow patterns that ensure user safety, maximum filtration, ignition of smoking media item 112, and device 100M ease of use. In an aspect, device 100M can replicate an authentic feel of traditional smoking, by recreating and maintaining an effective drag resistance (that occurs in traditional smoking of a cigarette or other media item) of inhaling a smoking media item 112 across inhale pathway 860. In a non-limiting embodiment, a distance between the holder component 110 and mouthpiece opening of mouthpiece air pathway component 280 can be minimized to reduce a resultant pressure applied to a smoke stream for inhalation as well as minimize cavity space within which smoke can linger.

In an aspect, a ballcheck valve can be positioned between first exhale pathway 850 and inhale pathway 860 to ensure that a mono-directional movement of smoke flows when smoke travels along the first exhale pathway 850 or along the inhale pathway 860 in order to minimize the resistance necessary to initiate such respective flows of smoke (e.g., less drag for comfortability). In an aspect, sphere component 610 can be located at the bottom of a "sloped valley" shaped enclosure such that the floor of the valley enclosure is a sealed orifice (e.g., ballcheck exhale duct opening 660) that is sealed by sphere component 610 being lodged within the orifice. However, sphere component 610 can be dislodged upon an inhalation event that causes the ball to move up the slope, thus allowing the smoke to selectively pass through the opening created from the dislodged sphere component 610.

In another non-limiting embodiment, a different type of mechanical valve or a sensor-activated electronic piston or solenoid can be employed to create a resistance associated with inhalation of smoke. In another aspect, the capability of device 100M to enable a single directional flow of smoke to be inhaled or exhaled based upon a proper sealing of a duct prevents the occurrence of problems arising based on leaked-exhale smoke or pressure causing an unsafe dislodgment of the smoking media item 112 from the holder component 110 and inefficiencies in filtration mechanisms.

In another aspect, during an inhalation event, an umbrella valve 240 (e.g., petal valve, solenoid or other valve) on the opposite side can open to allow an influx of fresh air to come through the point of ignition. In an aspect, a user can cease to inhale such that the valve can go back to its closed resting position to effectively cause a flame of the smoking media item 112 to smother itself and which reduces the need for having an idle burning smoking media item 112. In another aspect umbrella valve 240 can function to regulate a rate of compression or decompression of spring-helix component 210 to ensure smoking media item 112 is not crushed upon an inhale event or such that the lighter portion of device 100M does not slam against a bottom helix lighter portion 420. In another embodiment, umbrella valve 420 can have a dynamic aperture to account for a pressure loss through employment of different types of filters (e.g., cotton) and supplement the inflow of oxygen to standardize conditions in a variance of filtration scenarios.

In another aspect, given that device 100M does not require an ever-burning cigarette, there no need for device 100M to have an active or fan-powered filtration system due to the ability of device 100M to clear any small amount of smoke generated within any cavity upon subsequent exhales. In another aspect, a separate airflow is transferred during a user exhale into device 100M, where the exhale airflow enters through the same detachable mouthpiece assembly 102 that an inhalation pathway travel through. Furthermore, detachable mouthpiece assembly 102 has been optimized to create a strong seal with a user lips in order to maximize an efficacy of an exhale event.

Also, due to the ribbed contour of holder component 210, a strong seal is created with the circumference of a filter portion of smoking media item 112 to ensure a proper seating of the smoking media item 112 within holder component 210 and to prevent harmful side stream smoke to leak around the circumference of a filter of smoking media item 112 (e.g., cigarette filter). In another non-limiting embodiment, detachable mouthpiece assembly 102 can comprise a modular component capable of being personalized based on a user smoking preference or lip contour. In another aspect, in order to activate a flow of smoke to travel from detachable mouthpiece assembly 102 to an inner cavity of device 100M, a slight cracking pressure need be created to open a flap.

Due to the optimized fluid dynamics of device 100M, the exhale pathway is configured in-phase with contours of the inner helix of spring helix component 210 to achieve complete uninterrupted fluidity between spring helix component 210 and detachable mouthpiece assembly 102 once a butterfly valve has opened. In an aspect, upon entry of a secondhand smoke stream into an inner helix portion of spring helix component 210, the smoke travels down a helical tube, gaining more velocity as it proceeds through the corkscrew and exits the spring helix component 210 via a smoke exhaust component 230 (e.g., leak path). After passing through the leak-path the second-hand stream of smoke can spin around walls of cyclonic filter component 234 and then proceed up (vertically) into the center column of cyclonic filter component 234 and into electrical precipitator component 236.

In an aspect, a rubber, silicone or other sealant can surround an outer perimeter of a center column of electrical precipitator component 236 to ensure no leakage around the sides of a replaceable filter capsule occurs. In an aspect, the second stream travels from electrical precipitator component 236 through a HEPA media weave 246 and into activated carbon component 244. Furthermore, the smoke stream travels through exit nozzle component 106 and outside of device 100M.

Figure 1N:
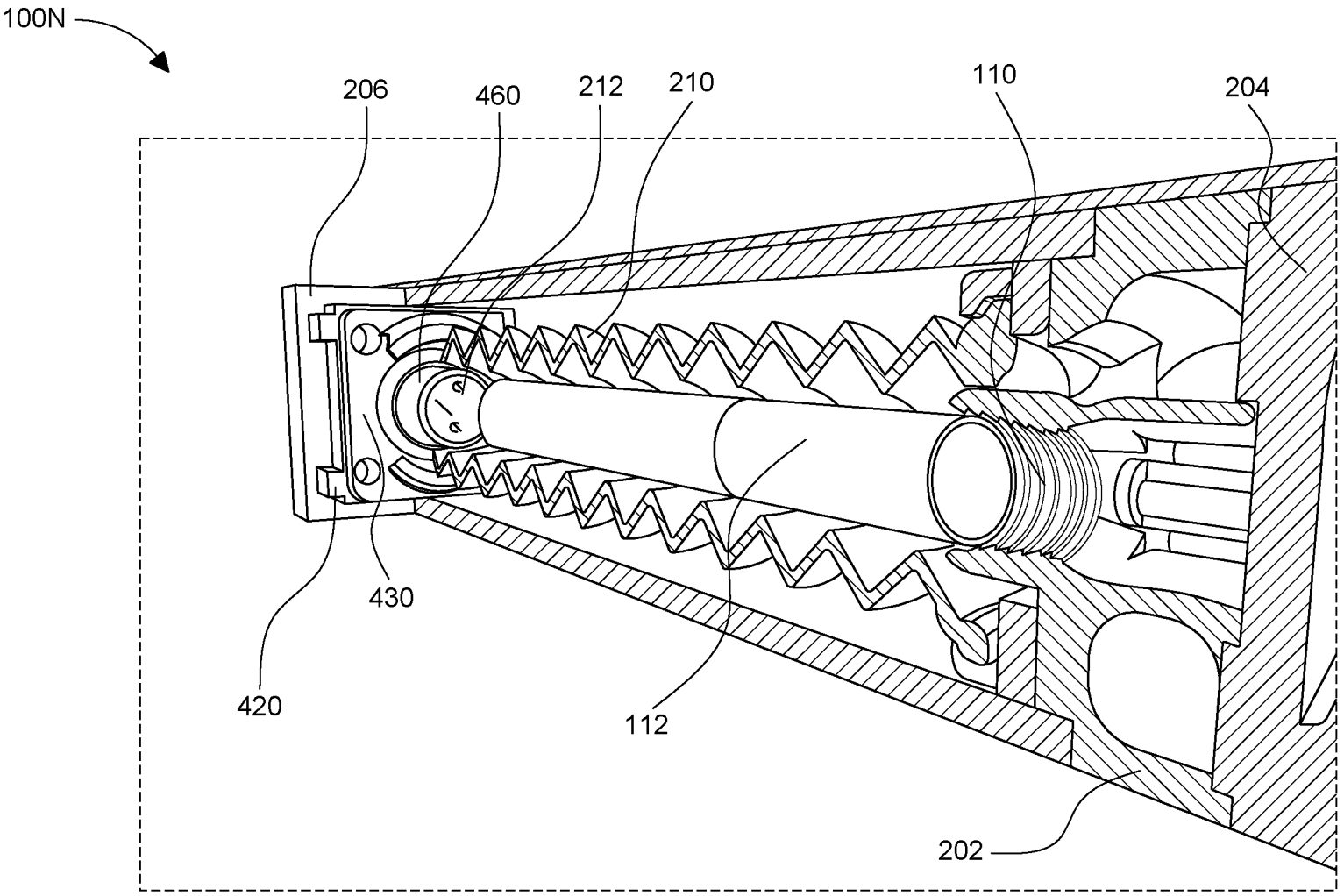
FIG. 1N illustrates a diagram of an example, cross-sectional, internal perspective view of a non-limiting smoking filtration device 100N, including but not limited to, a spring-helix holding chamber and ignition chamber assembly that can facilitate a filtered smoking of a smoking media item in accordance with one or more embodiments described herein.

FIG. 1N illustrates a diagram of an example, cross-sectional, internal perspective view of a non-limiting smoking filtration device 100N, including but not limited to, a spring-helix holding chamber and ignition chamber assembly that can facilitate a filtered smoking of a smoking media item in accordance with one or more embodiments described herein. Repetitive description of like elements employed in other embodiments described herein is omitted for sake of brevity.

In an aspect, device 100N illustrates several components of devices listed herein such as lighter-shuttle chassis component 206, ceramic hot plate 460, igniter air-inlet tunnel 212, spring-helix component 210, holder component 110, spring-helix fastening plate component 204, spring-helix holder slip portion 202, smoking media item 112, lighter-shuttle fastening plate and rivet system 430, and bottom helix lighter portion 420. In a non-limiting embodiment, ignition chamber assembly 275 can be comprised of a polycarbonate (or other thermally or chemically resistant plastic) bottom helix lighter portion 420 and an attached ceramic hot plate 460 which takes the brunt of heat and houses set of lighter terminals 440. In an aspect, a mechanism for ignition relies on an electrical arc-gap lighter wherein an uninterrupted flow of electrons can be present from terminal to terminal.

In another aspect, when spring helix component 210 is compressed to create contact between a cigarette (e.g., smoking media item 112) and ceramic hot plate 460 or set of lighter terminals 440, then the flow of electronics travels through an electrically resistive tobacco (or paper or herb) route, wherein such resistivity causes a conversion of electrical energy into thermal energy, thus combusting the cigarette. As such an arc lighter can be activated by a button or an automatic flow sensor that recognizes a user inhalation even is occurring, which completes the circuit and allows a current to flow through set of lighter terminals 440. Furthermore, in an aspect, a smothering of a cigarette after each drag allows for an igniter of device 100N to be active during each inhale occurs.

Figure 2:
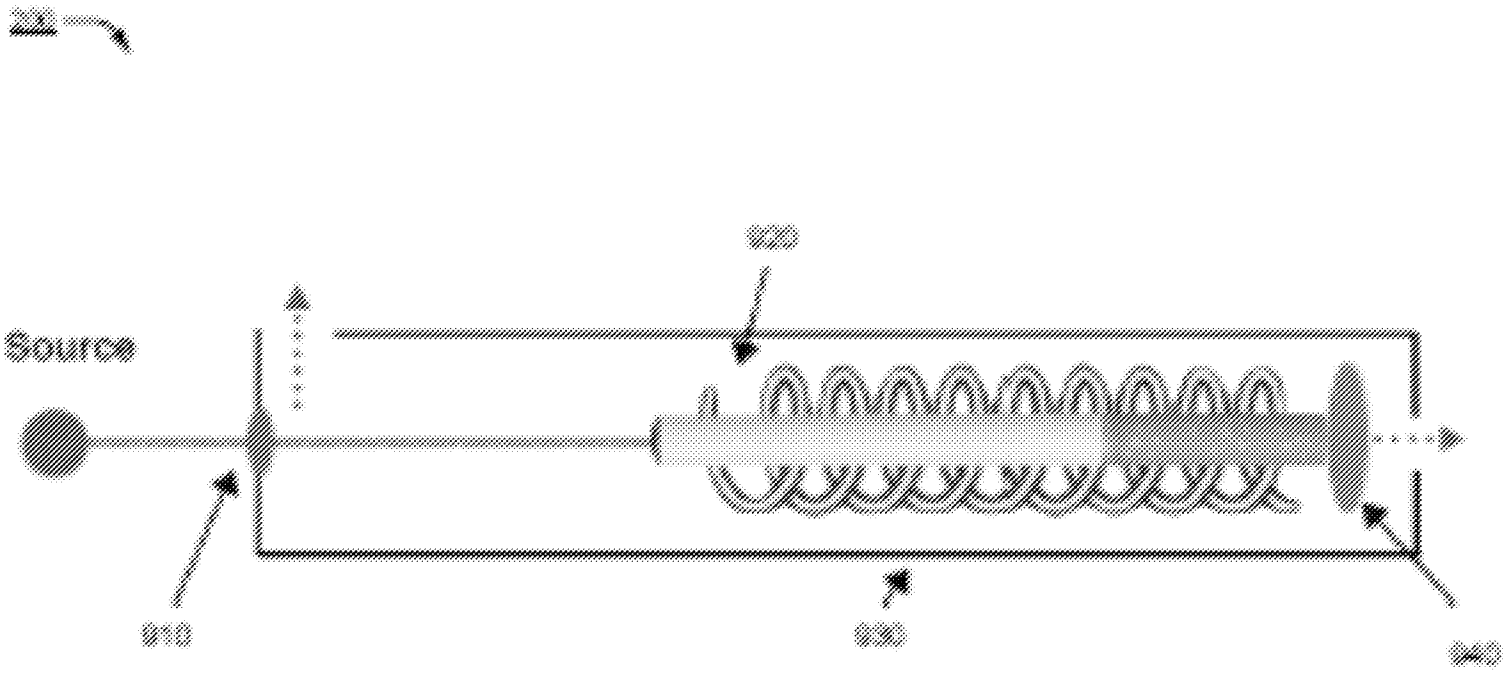
FIG. 2 illustrates a diagram of an example, perspective view of a non-limiting smoking filtration device, including but not limited to, a photonic or laser-initiated ignition mechanism for igniting a smoking media item and can facilitate a filtered smoking of the smoking media item in accordance with one or more embodiments described herein.

FIG. 2 illustrates a diagram of an example, perspective view of a non-limiting smoking filtration device, including but not limited to, a laser-initiated ignition mechanism for igniting a smoking media item and can facilitate a filtered smoking of the smoking media item in accordance with one or more embodiments described herein. Repetitive description of like elements employed in other embodiments described herein is omitted for sake of brevity.

In another non-limiting embodiment, a non-fume producing ignition alternative can be employed instead of an arc lighter such as a laser ignition mechanism. In such non-limiting embodiment, ignition chamber assembly 275 can remain in a fixed position due to a laser beam being employed to ignite a smoking media item 112 of any length and at any stage in its smoking style. As such, a laser beam has a long range of reach for purposes of ignition such that the spring helix component 210 can also be immovable (e.g., no compression required) and can be molded with a helical contour except that an inner cavity of device 200 does not need to be a separate piece.

In another non-limiting embodiment, device 200 can comprise a processor that can execute system components that allow for the tracking of data representing a number of cigarettes consumed over a period of time, quantity of contaminants and/or particles removed using respective filters individually or collectively, battery power level, level of THC detected (e.g., using sensors) within a unit of cannabis (e.g., present within cigarette), nicotine level consumed or within the atmosphere surrounding the system (or a device employing the system) average temperature required of ignition components during each smoke session, average unit of nicotine or other ingredient (e.g., tar, THC, etc.) inhaled during a target period of time, recommendations for cleaning particular components (e.g., filter, orifice, mouthpiece, etc.), usage or consumption-based data (e.g., how many cigarettes a user smokes in a given time, the quantity of active ingredient captured within a user lungs, etc.) and other such information associated with operations performed by components of the system.

Figure 3:
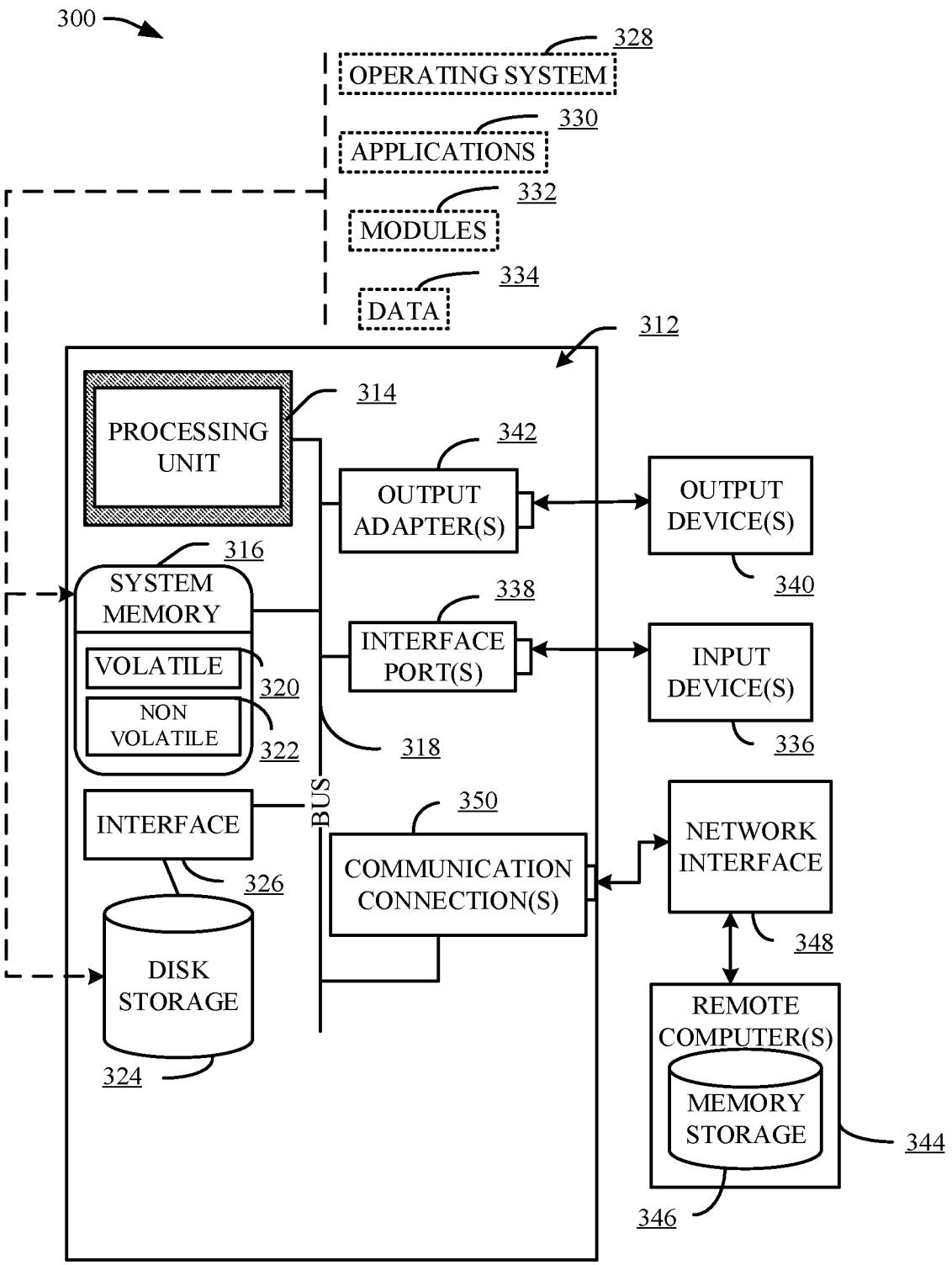
FIG. 3 illustrates a flow diagram of an example, non-limiting computer-implemented method 300 that facilitates a configuration of the first device from an application executing on a second device in accordance with one or more embodiments described herein.

FIG. 3 illustrates a flow diagram of an example, non-limiting computer-implemented method 300 that facilitates a configuration of the first device from an application executing on a second device in accordance with one or more embodiments described herein. Repetitive description of like elements employed in other embodiments described herein is omitted for sake of brevity.

In order to provide a context for the various aspects of the disclosed subject matter, FIG. 3 as well as the following discussion is intended to provide a general description of a suitable environment in which the various aspects of the disclosed subject matter can be implemented. FIG. 3 illustrates a block diagram of an example, non-limiting operating environment in which one or more embodiments described herein can be facilitated. With reference to FIG. 3, a suitable operating environment 300 for implementing various aspects of this disclosure can also include a computer 312. The computer 312 can also include a processing unit 314, a system memory 316, and a system bus 318. The system bus 318 couples system components including, but not limited to, the system memory 316 to the processing unit 314. The processing unit 314 can be any of various available processors. Dual microprocessors and other multiprocessor architectures also can be employed as the processing unit 314. The system bus 318 can be any of several types of bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Firewire (IEEE 394), and Small Computer Systems Interface (SCSI).

The system memory 316 can also include volatile memory 320 and nonvolatile memory 322. The basic input/output system (BIOS), containing the basic routines to transfer information between elements within the computer 312, such as during start-up, is stored in nonvolatile memory 322. By way of illustration, and not limitation, nonvolatile memory 322 can include read only memory (ROM), programmable ROM (PROM), electrically programmable ROM (EPROM), electrically erasable programmable ROM (EEPROM), flash memory, or nonvolatile random access memory (RAM) (e.g., ferroelectric RAM (FeRAM). Volatile memory 320 can also include random access memory (RAM), which acts as external cache memory. By way of illustration and not limitation, RAM is available in many forms such as static RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), direct Rambus RAM (DRRAM), direct Rambus dynamic RAM (DRDRAM), and Rambus dynamic RAM.

Computer 312 can also include removable/non-removable, volatile/non-volatile computer storage media. FIG. 3 illustrates, for example, a disk storage 324. Disk storage 324 can also include, but is not limited to, devices like a magnetic disk drive, floppy disk drive, tape drive, Jaz drive, Zip drive, LS-100 drive, flash memory card, or memory stick. The disk storage 324 also can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage 324 to the system bus 318, a removable or non-removable interface is typically used, such as interface 326. FIG. 3 also depicts software that acts as an intermediary between users and the basic computer resources described in the suitable operating environment 300. Such software can also include, for example, an operating system 328. Operating system 328, which can be stored on disk storage 324, acts to control and allocate resources of the computer 312.

System applications 330 take advantage of the management of resources by operating system 328 through program modules 332 and program data 334, e.g., stored either in system memory 316 or on disk storage 324. It is to be appreciated that this disclosure can be implemented with various operating systems or combinations of operating systems. A user enters commands or information into the computer 312 through input device(s) 336. Input devices 336 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 314 through the system bus 318 via interface port(s) 338. Interface port(s) 338 include, for example, a serial port, a parallel port, a game port, and a universal serial bus (USB). Output device(s) 340 use some of the same type of ports as input device(s) 336. Thus, for example, a USB port can be used to provide input to computer 312, and to output information from computer 312 to an output device 340. Output adapter 342 is provided to illustrate that there are some output devices 340 like monitors, speakers, and printers, among other output devices 340, which require special adapters. The output adapters 342 include, by way of illustration and not limitation, video and sound cards that provide a means of connection between the output device 340 and the system bus 318. It should be noted that other devices and/or systems of devices provide both input and output capabilities such as remote computer(s) 344.

Computer 312 can operate in a networked environment using logical connections to one or more remote computers, such as remote computer(s) 344. The remote computer(s) 344 can be a computer, a server, a router, a network PC, a workstation, a microprocessor based appliance, a peer device or other common network node and the like, and typically can also include many or all of the elements described relative to computer 312. For purposes of brevity, only a memory storage device 346 is illustrated with remote computer(s) 344. Remote computer(s) 344 is logically connected to computer 312 through a network interface 348 and then physically connected via communication connection 350. Network interface 348 encompasses wire and/or wireless communication networks such as local-area networks (LAN), wide-area networks (WAN), cellular networks, etc. LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL). Communication connection(s) 350 refers to the hardware/software employed to connect the network interface 348 to the system bus 318.

While communication connection 350 is shown for illustrative clarity inside computer 312, it can also be external to computer 312. The hardware/software for connection to the network interface 348 can also include, for exemplary purposes only, internal and external technologies such as, modems including regular telephone grade modems, cable modems and DSL modems, ISDN adapters, and Ethernet cards.

Figure 4:
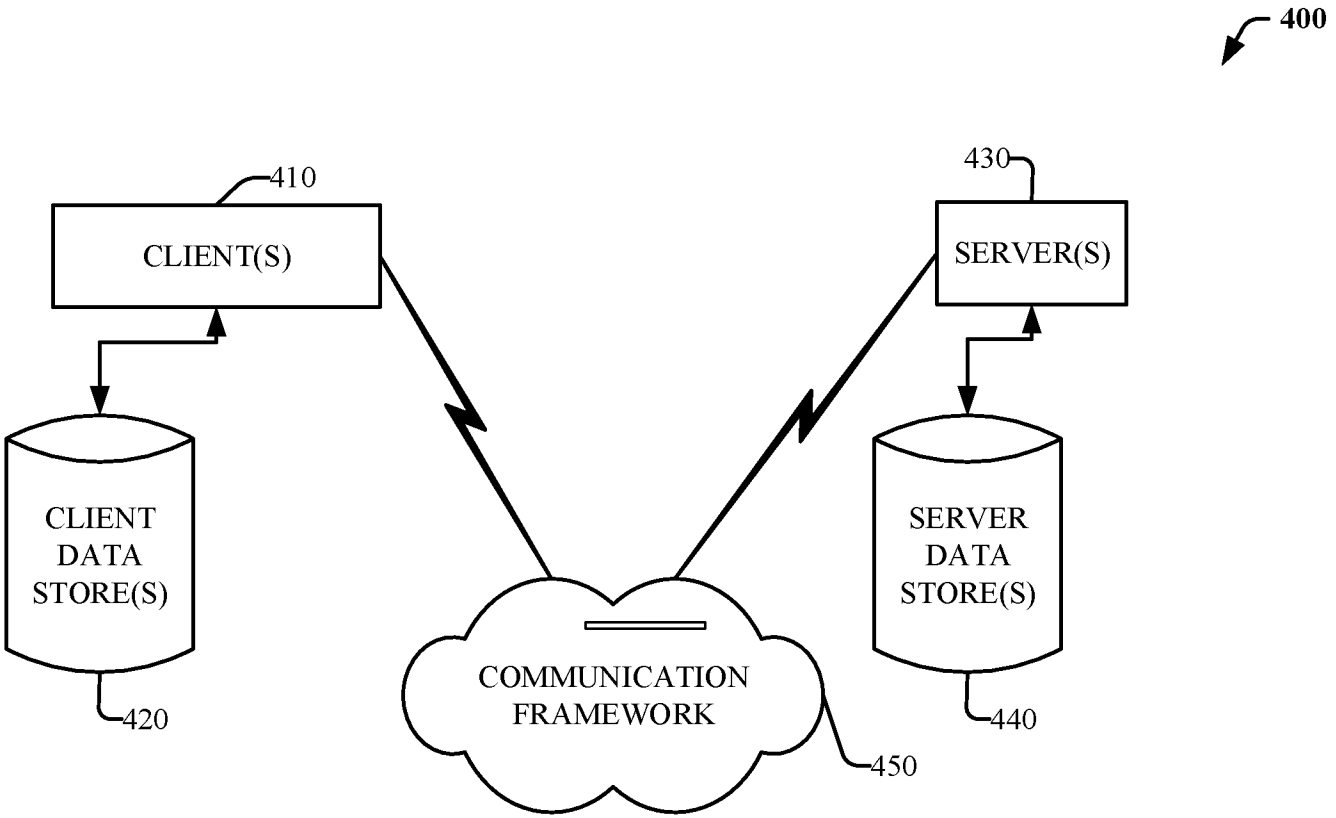
FIG. 4 illustrates a block diagram of an example, non-limiting operating environment 400 in which one or more embodiments described herein can be facilitated.

FIG. 4 illustrates a block diagram of an example, non-limiting operating environment 400 in which one or more embodiments described herein can be facilitated. Repetitive description of like elements employed in other embodiments described herein is omitted for sake of brevity.

Referring now to FIG. 4, there is illustrated a schematic block diagram of a computing environment 400 in accordance with this disclosure. The system 400 includes one or more client(s) 402 (e.g., laptops, smart phones, PDAs, media players, computers, portable electronic devices, tablets, and the like). The client(s) 402 can be hardware and/or software (e.g., threads, processes, computing devices). The system 400 also includes one or more server(s) 404. The server(s) 404 can also be hardware or hardware in combination with software (e.g., threads, processes, computing devices). The servers 404 can house threads to perform transformations by employing aspects of this disclosure, for example. One possible communication between a client 402 and a server 404 can be in the form of a data packet transmitted between two or more computer processes wherein the data packet may include video data. The data packet can include a metadata, e.g., associated contextual information, for example. The system 400 includes a communication framework 406 (e.g., a global communication network such as the Internet, or mobile network(s)) that can be employed to facilitate communications between the client(s) 402 and the server(s) 404.

Communications can be facilitated via a wired (including optical fiber) and/or wireless technology. The client(s) 402 include or are operatively connected to one or more client data store(s) 408 that can be employed to store information local to the client(s) 402 (e.g., associated contextual information). Similarly, the server(s) 404 are operatively include or are operatively connected to one or more server data store(s) 410 that can be employed to store information local to the servers 404. In one embodiment, a client 402 can transfer an encoded file, in accordance with the disclosed subject matter, to server 404. Server 404 can store the file, decode the file, or transmit the file to another client 402. It is to be appreciated, that a client 402 can also transfer uncompressed file to a server 404 and server 404 can compress the file in accordance with the disclosed subject matter. Likewise, server 404 can encode video information and transmit the information via communication framework 406 to one or more clients 402.

The present disclosure may be a system, a method, an apparatus and/or a computer program product at any possible technical detail level of integration. The computer program product can include a computer readable storage medium (or media) having computer readable program instructions thereon for causing a processor to carry out aspects of the present disclosure. The computer readable storage medium can be a tangible device that can retain and store instructions for use by an instruction execution device. The computer readable storage medium can be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium can also include the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network can comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device. Computer readable program instructions for carrying out operations of the present disclosure can be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions can execute entirely on the user's computer, partly on the user's computer, as a stand-alone software package, partly on the user's computer and partly on a remote computer or entirely on the remote computer or server. In the latter scenario, the remote computer can be connected to the user's computer through any type of network, including a local area network (LAN) or a wide area network (WAN), or the connection can be made to an external computer (for example, through the Internet using an Internet Service Provider). In some embodiments, electronic circuitry including, for example, programmable logic circuitry, field-programmable gate arrays (FPGA), or programmable logic arrays (PLA) can execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer readable program instructions. These computer readable program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions can also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks. The computer readable program instructions can also be loaded onto a computer, other programmable data processing apparatus, or other device to cause a series of operational acts to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present disclosure. In this regard, each block in the flowchart or block diagrams can represent a module, segment, or portion of instructions, which comprises one or more executable instructions for implementing the specified logical function(s). In some alternative implementations, the functions noted in the blocks can occur out of the order noted in the Figures. For example, two blocks shown in succession can, in fact, be executed substantially concurrently, or the blocks can sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the subject matter has been described above in the general context of computer-executable instructions of a computer program product that runs on a computer and/or computers, those skilled in the art will recognize that this disclosure also can or can be implemented in combination with other program modules. Generally, program modules include routines, programs, components, data structures, etc. that perform particular tasks and/or implement particular abstract data types. Moreover, those skilled in the art will appreciate that the inventive computer-implemented methods can be practiced with other computer system configurations, including single-processor or multiprocessor computer systems, mini-computing devices, mainframe computers, as well as computers, hand-held computing devices (e.g., PDA, phone), microprocessor-based or programmable consumer or industrial electronics, and the like. The illustrated aspects can also be practiced in distributed computing environments in which tasks are performed by remote processing devices that are linked through a communications network. However, some, if not all aspects of this disclosure can be practiced on stand-alone computers. In a distributed computing environment, program modules can be located in both local and remote memory storage devices.

As used in this application, the terms "component," "system," "platform," "interface," and the like, can refer to and/or can include a computer-related entity or an entity related to an operational machine with one or more specific functionalities. The entities disclosed herein can be either hardware, a combination of hardware and software, software, or software in execution. For example, a component can be, but is not limited to being, a process running on a processor, a processor, an object, an executable, a thread of execution, a program, and/or a computer. By way of illustration, both an application running on a server and the server can be a component. One or more components can reside within a process and/or thread of execution and a component can be localized on one computer and/or distributed between two or more computers. In another example, respective components can execute from various computer readable media having various data structures stored thereon. The components can communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software or firmware application executed by a processor. In such a case, the processor can be internal or external to the apparatus and can execute at least a part of the software or firmware application. As yet another example, a component can be an apparatus that provides specific functionality through electronic components without mechanical parts, wherein the electronic components can include a processor or other means to execute software or firmware that confers at least in part the functionality of the electronic components. In an aspect, a component can emulate an electronic component via a virtual machine, e.g., within a cloud computing system.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. As used herein, the terms "example" and/or "exemplary" are utilized to mean serving as an example, instance, or illustration. For the avoidance of doubt, the subject matter disclosed herein is not limited by such examples. In addition, any aspect or design described herein as an "example" and/or "exemplary" is not necessarily to be construed as preferred or advantageous over other aspects or designs, nor is it meant to preclude equivalent exemplary structures and techniques known to those of ordinary skill in the art.

As it is employed in the subject specification, the term "processor" can refer to substantially any computing processing unit or device comprising, but not limited to, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Further, processors can exploit nano-scale architectures such as, but not limited to, molecular and quantum-dot based transistors, switches and gates, in order to optimize space usage or enhance performance of user equipment. A processor can also be implemented as a combination of computing processing units. In this disclosure, terms such as "store," "storage," "data store," data storage," "database," and substantially any other information storage component relevant to operation and functionality of a component are utilized to refer to "memory components," entities embodied in a "memory," or components comprising a memory. It is to be appreciated that memory and/or memory components described herein can be either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), flash memory, or nonvolatile random access memory (RAM) (e.g., ferroelectric RAM (FeRAM). Volatile memory can include RAM, which can act as external cache memory, for example. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), direct Rambus RAM (DRRAM), direct Rambus dynamic RAM (DRDRAM), and Rambus dynamic RAM (RDRAM). Additionally, the disclosed memory components of systems or computer-implemented methods herein are intended to include, without being limited to including, these and any other suitable types of memory.

What has been described above include mere examples of systems and computer-implemented methods. It is, of course, not possible to describe every conceivable combination of components or computer-implemented methods for purposes of describing this disclosure, but one of ordinary skill in the art can recognize that many further combinations and permutations of this disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A device comprising:

an outer sleeve component comprising a first cavity portion and a second cavity portion; a detachable mouthpiece assembly configured for insertion into or removal from the first cavity portion, wherein the detachable mouthpiece assembly comprises;

a holder component configured to hold a smoking media item based on a gripping mechanism;

a mouthpiece air pathway component configured to transfer a first stream of smoke in a first direction corresponding to an inhale pathway or a second stream of smoke in a second direction corresponding to an exhale pathway, wherein the first direction is opposite to the second direction;

a first valve component configured to direct a first flow of smoke from the smoking media item to the inhale pathway via a contoured smoke propagation cavity and a central inhale route; and an exhale ballcheck valve assembly configured to direct a second flow of smoke through the exhale pathway;

an ignition chamber assembly configured to generate the stream of smoke for movement in the first direction and transition the second stream of smoke between a set of device components;

wherein the ignition chamber assembly is configured to attach to the detachable mouthpiece assembly, and wherein the ignition chamber assembly is connected to a spring helix assembly comprises comprising:

a spring-helix component within a spring-helix holding chamber portion, wherein the spring-helix component is configured to house the smoking media item and based on an exhale event, facilitate a transference of the second flow of smoke from a spring helical cavity into a filtration assembly via a smoke exhaust component that is a connection pathway between the spring helical cavity and a cyclonic filter component of the filter assembly; and an ignition component within the ignition chamber assembly configured to generate a flame based on an electrical ignition mechanism, wherein the flame is capable of igniting the smoking media item;

a detachable filtration assembly configured for insertion into or removal from the second cavity portion, wherein the detachable filtration assembly removes a set of particles from the second flow of smoke, wherein the detachable filtration assembly is connected to the spring helix assembly via a central structural column, and wherein the detachable filtration assembly comprises:

a curved smoke diffuser configured to distribute air pressure in a manner that spreads the second flow of smoke through a set of filtration membranes into a HEPA media weave component;

a HEPA media weave component configured to mitigate a loss of air pressure of the second flow of smoke based on a folding style of a set of HEPA media folds corresponding to the HEPA media weave component, wherein the HEPA media weave component comprises a HEPA fabric with glass fiber membranes;

an activated carbon component configured to adsorb a HEPA media filtrated flow of smoke;

and an exit nozzle component located at a top portion of the detachable filtration assembly and configured to remove a filtered second stream of smoke.

2. The device of claim 1, further comprising a set of structural weave pegs comprising elongated pegs configured to bend the HEPA media weave component into a secure position to facilitate an increased capture of portions of the second smoke stream as compared to an absence of the set of structural weave pegs, wherein a central weave peg represents a larger peg than the set of structural weave pegs configured to apply sufficient tension to longer portions of fabric corresponding to the HEPA media weave component.

3. The device of claim 1, further comprising an encrypted processor configured to clip into the partially detachable filter assembly, wherein the encrypted processor is connected to a filter pod base component configured to form a seal with a cyclonic filter component.

4. The device of claim 3, further comprising an electrical precipitator component connected to the cyclonic filter component and a pre-filter umbrella valve component, wherein the electrical precipitator component positively charges a set of particles that pass through a positively charged mesh portion of the electrical precipitator component, wherein the pre-filter umbrella valve component configured to bar smoke within a HEPA filter housing portion of the detachable filtration assembly from entering the electrical precipitator component, and wherein the pre-filter umbrella valve component is mounted on the filter pod base.

5. The device of claim 4, further comprising a removable filter pod endcap component that covers a filter pod cavity portion of the HEPA filter housing portion, wherein the removable filter pod endcap component locks a removable filter pod component within the filter pod cavity portion.

6. The device of claim 1, further comprising a spring-helix fastening plate component that connects a spring-helix holder slip portion of the spring-helix component to the detachable mouthpiece assembly, wherein the spring-helix is a compressible spring, and wherein the spring-helix fastening plate component is mounted to an upper portion shuttle rail assembly of a set of inner walls of the spring-helix holding chamber.

7. The device of claim 1, further comprising a lighter-shuttle chassis component comprising a pressure differential surface and a valve insert portion configured to receive a portion of an first valve within an insertion point of the valve insert portion, wherein the first valve allows a one-way airflow to be released into an ignition cavity, wherein the pressure differential surface comprises a inner contour shape configured to nest the first valve in phase with an internal cavity portion of the spring helix component, wherein a male portion of the first valve is configured to securely click into the insertion point of the valve insert portion, wherein the first valve at a resting position creates a sealed barrier to airflow, and wherein the first valve comprises at least one of a mechanical valve, an electrical valve, an umbrella valve or pneumatically driven valve.

8. The device of claim 7, wherein the lighter-shuttle chassis component attaches to a lower portion shuttle rail assembly of the set of inner walls of the holding chamber, wherein the lighter-shuttle chassis component aligns a lighter-shuttle assembly with the smoke exhaust component, wherein the smoke exhaust component is a tunnel between the spring-helix holding chamber portion and the cyclonic filter component, wherein the lower portion shuttle rail assembly comprises inset grooves of a set of inner walls of the helix-spring holder chamber, and wherein the lighter-shuttle assembly comprises a lighter-shuttle fastening plate and rivet system configured to create a seal between the bottom helix lighter portion, a ceramic hot plate, and the lighter-shuttle chassis component based on a set of lighter-shuttle fastening plate pegs.

9. The device of claim 8, further comprising an ash sediment collection portion of the cyclonic filter component, wherein the ash sediment collection portion is connected to a detachable ashtray endcap component, and wherein the detachable ashtray endcap component allows for a collection or disposal of ash from the smoking media item.

10. The device of claim 7, further comprising a lighter-shuttle fastening plate configured to clamp a bottom helix lighter portion of the spring helix component between the lighter-shuttle fastening plate and the lighter-shuttle chassis component.

11. The device of claim 7, further comprising an igniter air-inlet tunnel that directs air from the first valve to a central location of an arc lighter housing component comprising a set of arc lighter terminals configured to facilitate an ignition based on an electric spark gap formed by the set of arc lighter terminals based on a spark blown, by an inhalation airflow, towards a tip of the smoking media item.

12. The device of claim 1, further comprising an accordion electrical route component connected to a lower portion of the spring helix component and an electrical interface component, wherein the accordion electrical route component comprises a compressible insulated electrical wire that supplies power to the ignition chamber assembly.

13. The device of claim 1, further comprising an external air-inlet orifice configured to facilitate a supply of air into the device.

14. The device of claim 1, further comprising an electrical housing component connected to an electrical housing fastening plate and the electrical interface component, wherein the electrical housing component is configured as a receptacle for a set of electronics comprising at least one of a sensor logic board, a battery, and a printed circuit board, and wherein the electrical housing component is mounted to an external air-inlet orifice base plate.

15. The device of claim 1, further comprising an extended HEPA media component connected to a HEPA media weave component, wherein the extended HEPA media component receives smoke passed through a curved smoke diffuser, and wherein the extended HEPA media component comprises a thinner and less compact organization of HEPA media as compared to traditional HEPA media.

16. The device of claim 15, further comprising a set of pinholes and grooves extending from at least a portion of a set of inner walls of a filter housing capable of interlocking with a partially detachable filter assembly.

17. The device of claim 1, further comprising a laser diode configured to ignite the smoking media item based on a laser initiated ignition mechanism.

18. The device of claim 1, wherein the exhale pathway comprises a smoke intake portion, an exhale ballcheck duct, and a ballcheck exhale duct opening, wherein the exhale ballcheck duct is a pathway for the second flow of smoke to travel within based upon a dislodging of a sphere component within the ballcheck exhale duct opening, wherein the exhale ballcheck valve assembly further comprises the sphere component configured to seal the ballcheck exhale duct opening of the exhale pathway, wherein the exhale ballcheck duct is in phase with an internal corkscrew shaped contour of the spring-helix component, wherein the first valve component is a butterfly valve, wherein the cyclonic filter component is configured to remove ash and a set of smoke particles of a range of sizes from the second flow of smoke based on a velocity-based filtration mechanism, wherein the curved smoke diffuser comprises a set of pinhole openings that facilitate a distribution of the second flow of smoke to a set of inner walls of the detachable filtration assembly, wherein the folding style is a V-bank filter that has a greater surface area than a traditional HEPA filter, wherein the activated carbon component comprises a set of carbon pellets comprising at least one of a carbon stick, carbon sphere, or carbon granule capable of adsorbing smoke particles from the second stream of smoke, wherein the mouthpiece air pathway component comprises vented stress point configured to generate a cracking pressure capable of dislodging the sphere component, and wherein the contoured smoke propagation cavity aggregates disparate smoke streams into a unified channel of smoke.

* * * * *